US010352026B2

(12) United States Patent
Lloyd

(10) Patent No.: US 10,352,026 B2
(45) Date of Patent: Jul. 16, 2019

(54) COUNTERTOP UNDERMOUNT SUPPORT

(71) Applicant: Peter Lloyd, Ontario (CA)

(72) Inventor: Peter Lloyd, Ontario (CA)

(73) Assignee: Peter Lloyd (CA)

( * ) Notice: Subject to any disclaimer, the term of this patent is extended or adjusted under 35 U.S.C. 154(b) by 321 days.

(21) Appl. No.: 15/232,954

(22) Filed: Aug. 10, 2016

(65) Prior Publication Data

US 2018/0044901 A1 Feb. 15, 2018

(51) Int. Cl.
*A47B 95/00* (2006.01)
*E03C 1/33* (2006.01)
*A47B 77/06* (2006.01)

(52) U.S. Cl.
CPC ..... *E03C 1/335* (2013.01); *A47B 77/06* (2013.01); *A47B 95/00* (2013.01); *E03C 1/33* (2013.01)

(58) Field of Classification Search
CPC . E03C 1/335; E03C 1/33; A47B 95/00; A47B 77/06; A47B 96/00; A47B 96/022; A47B 96/024; A47B 96/06; A47B 96/14; A47B 51/00; A47B 77/04; A47B 88/423
USPC ..... 248/200.1, 220.21, 221.11, 222.11, 248/222.12, 224.61, 224.8; 312/228, 312/257.1, 350
See application file for complete search history.

(56) References Cited

U.S. PATENT DOCUMENTS 1,727,159 A * 9/1929 Coulter ..... E03C 1/33 4/631
2,600,599 A * 6/1952 Wycoff ..... E03C 1/33 4/632
3,071,780 A * 1/1963 Lyon, Jr. ..... E03C 1/33 292/80
3,191,191 A * 6/1965 Juergens ..... E03C 1/33 248/27.1
5,392,934 A * 2/1995 Fox ..... A47B 95/008 211/103
5,538,208 A 7/1996 Cordes
5,683,157 A * 11/1997 Peterson ..... A47J 33/00 312/100
5,743,501 A * 4/1998 Rapp ..... E03C 1/33 248/200.1
5,860,172 A * 1/1999 Pfeiffer ..... E03C 1/18 312/228
6,986,174 B2 * 1/2006 Brown ..... A47K 1/05 4/631
7,429,021 B2 * 9/2008 Sather ..... E03C 1/33 248/200.1
8,898,827 B2 * 12/2014 Aldrich ..... E03C 1/33 4/631
9,019,266 B2 * 4/2015 Hoguet ..... G06Q 10/06 345/419
9,286,422 B2 * 3/2016 Zhu ..... G06F 17/5018
2006/0048295 A1 * 3/2006 Aldrich ..... E03C 1/33 4/631

(Continued)

*Primary Examiner* — Ryan J. Walters
*Assistant Examiner* — Lawrence Averick
(74) *Attorney, Agent, or Firm* — Michael P. Mazza, LLC

(57) ABSTRACT

An undermount support for an appliance, and a method for using the support, the support including a frame that is: (a) assembled around the exterior periphery of the appliance; (b) located in supporting contact below the underside of a rim flange of the appliance; and (c) attached to cabinetry supporting a countertop or cooktop. The frame thereby enables the cabinetry to support the appliance by the rim flange.

17 Claims, 17 Drawing Sheets

(56) References Cited

U.S. PATENT DOCUMENTS

| | | | | |
|---|---|---|---|---|
| 2007/0240913 | A1* | 10/2007 | Schermerhom | G06F 3/0436 178/18.04 |
| 2008/0087778 | A1* | 4/2008 | Sather | E03C 1/33 248/201 |
| 2010/0090072 | A1* | 4/2010 | Jones | E03C 1/33 248/201 |
| 2010/0175182 | A1* | 7/2010 | Konno | A47B 77/06 4/630 |
| 2010/0230563 | A1* | 9/2010 | Flynn | A47K 1/05 248/201 |
| 2010/0301175 | A1* | 12/2010 | Grayson | E03C 1/33 248/27.1 |
| 2011/0207873 | A1* | 8/2011 | DiGuilio | C07C 255/24 524/500 |
| 2012/0159703 | A1* | 6/2012 | Miller | E03C 1/18 4/660 |
| 2012/0204343 | A1* | 8/2012 | Shollmier | E03C 1/18 4/631 |
| 2013/0193779 | A1* | 8/2013 | Kuroda | H02K 33/12 310/15 |
| 2015/0225975 | A1* | 8/2015 | Sugita | F16F 15/02 52/167.1 |

* cited by examiner

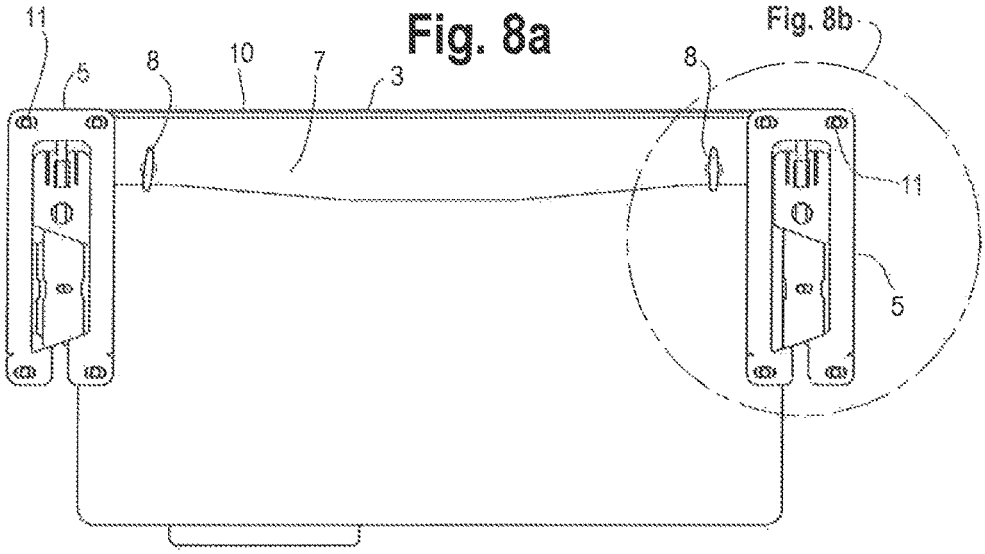
Fig. 8a
Fig. 8b
11
5
8
10
7
3
8
11
5
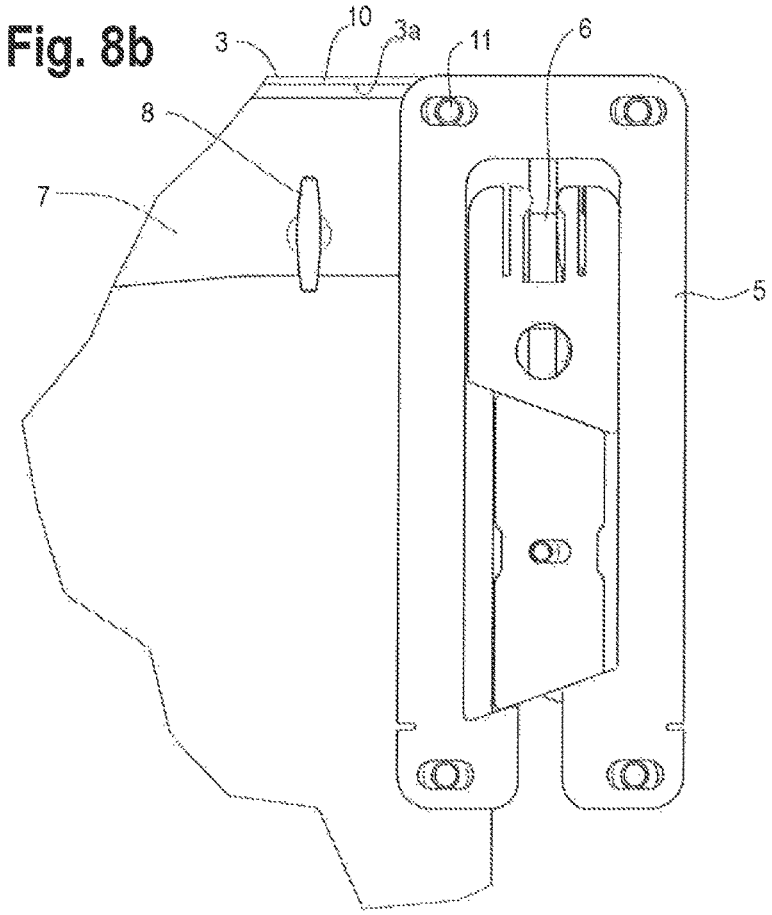
Fig. 8b
3
10
3a
11
6
8
7
5

POSITION A

POSITION B

POSITION C

POSITION D

COUNTERTOP UNDERMOUNT SUPPORT

BACKGROUND OF THE INVENTION

The present invention generally relates to an undermount support, to support and install sinks. More specifically, the invention relates to an undermount support that is primarily used to support and install all types and shapes of kitchen and bathroom undermount sinks, and may also be used to support countertops, kitchen countertop cooktops, and bathroom vessel sinks, such as those typically found in new residential construction.

Undermount sinks are primarily manufactured from stainless steel, copper, quartz, composite, fireclay or enameled cast iron, and are generally available in single, double and triple bowl configurations. Almost all undermount sinks have a continuous top rim flange that is designed to carry the full weight of a loaded sink.

Larger single and double-bowl undermount kitchen sinks may fit into European designed box style cabinets (frameless) that are approximately 36-inches long (Ikea). The heaviest double bowl sinks are made of enameled cast iron and can weigh up to 144 lbs. The manufacturer of these sinks recommends that the support structure be capable of supporting 300 pounds, and that the sink not be attached directly to the underside of the countertop.

Triple-bowl undermount kitchen sinks are generally manufactured from stainless steel or copper, are approximately 40-inches to 48-inches long, and require substantial support when fully loaded with water, dishes, pots and cutlery, etc. Again, it is not recommended to attach heavy triple-bowl sinks directly to the underside of a countertop, which often includes a large sink cut out and many faucet holes, as the countertop is at its weakest at this location. Accordingly, triple-bowl enameled cast iron sinks are usually drop-in (top mount) units due to their weight.

Various methods of mounting undermount sinks are presently being used. One popular method is to construct a permanent wooden frame (generally mounted inside the cabinet) on which the sink's rim flange sits. The countertop (quartz, granite, marble and concrete, etc) is then installed over the sink and cabinet using a silicon sealant between the sink's rim flange and the countertop. The silicon will become contaminated with bacteria and mold. The only way to completely remove all of the old silicon and properly clean the adjoining surfaces is by dismantling the wooden support structure or by lifting the countertop. Generally, it will be difficult to try to dig out and replace the contaminated silicon that can be seen without disturbing the wooden frame, sink or countertop. This is not considered a proper repair and the life of the fresh silicon will be reduced.

U.S. Pat. No. 5,538,208 to Sather discloses an undermount sink support that sits (rests) on the top edges (can be secured by screws) of the vertical elements of the cabinet that support the countertop. Vertical adjustment screws make contact with the sink's rim flange and are used to support and align the sink. Turning out the adjustment screws would allow the sink to be lowered slightly (after cutting through the silicon bead located between the sink's top rim flange and countertop and disconnecting the drain's plumbing), allowing the old silicon to be replaced. However, this type of design gives very little space (limited by screw thread length and longitudinal rail clearance) for proper removal of the silicon and proper cleaning of the adjoining surfaces. The sink cannot be completely removed (lowered) as the side supports sit on top of the cabinet's vertical elements and are usually held in place by screws. If the screws were to be left out, the support structure could be removed. Reinstallation, however, would be tricky due to the lack of working space, as the sink would have to be held in place as the supports are relocated. Another problem with this type of support structure is that it only intermittently supports two sides of the sink's rim flange using adjustment screws (rim is continuous around four sides). This allows the support structure, the sink's rim flange and the silicon joint to flex as weight is applied and released (normal filling and emptying of the sink with water, dishes, pots and cutlery, etc), and over time causes the silicon to delaminate, which enhances the promotion of bacteria and mold.

U.S. Pat. No. 5,743,501 to Rapp discloses an improved support (mounting) structure but still only intermittently supports (vertical adjustment screws) two sides of the sink's rim flange and again, to a lesser degree, allows the support structure, the sink's rim flange and silicon joint to flex as weight is applied and released. With this design, the adjustment screws are mounted in the slotted support rails and make contact with the sink's rim flange, and are again used to support and align the sink. This design could allow the sink to be lowered slightly (after cutting through the silicon bead located between the sink's top rim flange and countertop and disconnecting the drain's plumbing), allowing the old silicon to be replaced. Again, this type of design provides very little space for proper removal of silicon and proper cleaning of adjoining surfaces. The sink cannot be removed (lowered), as the side support bracket's fingers are located in the top nut receptacle channel of the rails. The side support brackets also sit on top and overhang the cabinet's vertical elements and are usually held in place by screws. In this configuration, the support structure and sink must be installed before the countertop is installed. Also the cabinet's vertical side's top surface must be recessed to allow the side supports to sit flush with the top surface that makes contact with the bottom side of the countertop. The alternative is to place the rail's open underside on top of the fingers, which would allow the rails to be removed. Mounting the rails on top of the fingers is not as secure as using the nut receptacle channel. Reinstallation would be tricky due to the lack of working space, as the sink would have to be held in place as the supports are relocated.

Another problem with support structures that use adjusting screws that directly make contact with the sink's rim flange (metal to metal) is the transmission of sound through the support structure to the cabinet's box structure. The cabinet can in some cases amplify the sound generated by the sink. Plastic pads are sometimes fitted to the adjusting screws to prevent metal to metal contact.

U.S. Pat. No. 6,986,174 to Brown discloses another type of mounting structure using seaming compound and perforated mounting plates that are bonded to the underside of the countertop. This can be a problem when using European cabinets, as insufficient space is available to locate the mounting plates and brackets. Intermittently mounting the plates and brackets around the sink's rim flange will cause the flange and silicon joint to flex as weight is applied and released. Also, bonding failures have occurred with fully loaded sinks, causing the sink to drop.

Still other methods are available to attach the sink to the underside of the countertop. One of the more popular of these methods is to drill blind holes in the underside of the countertop and fit epoxy threaded inserts into the holes. The holes can be drilled on all four sides where the sink's flange will sit (generally up to eight holes, if space permits). Any time a hole is drilled into the underside of a countertop, stress risers are setup, which can lead to cracking. Studs are then installed into the threaded inserts, and brackets are attached to the studs using threaded nuts or wing nuts. The brackets make contact with the sink's rim flange and the underside of the countertop. When the nuts are tightened, the sink is pulled into contact with the underside of the countertop. Over-tightening of the nuts can cause the inserts to pull out and sometimes cause the countertop to crack. The main advantage of this mounting structure over the adjustment screw and rail type is that the sink can easily be lowered to replace the silicon joint, and sound transmission to the cabinet is very low.

Various other support structures have been used to support or attach an undermount sink to the underside of a countertop. One example uses four brackets that are hammered into the cabinet's vertical support's top and side surfaces (two per side) before the countertop is fitted. The brackets have adjusting screws that make contact with the sink's rim flange. No longitudinal rails are used in this design and the sink's rim flange is only intermittently supported at the two ends by the four adjusting screws (sink's rim flange is continuous around four sides). This allows the sink's rim flange and the silicon joint to flex as the sink's rim flange is not supported along the two main longitudinal runs, which would cause excessive distortion and delamination of the rim flange silicon joint. The main advantage of this mounting structure over the adjustment screw and rail type is that the sink can be lowered to replace the silicon joint. However, sound transmission to the cabinet is high compared to the present invention.

A low cost design that does not use adjusting screws, or the sink's rim flange for support, is the universal sink harness that uses wire loops attached to the cabinet's vertical sides by clips (two per side for a double bowl sink). Each clip is attached to the cabinet's side by two screws. The wire is attached to one clip, is then passed under the sink's bowl and attached (wrapped around) to a draw bolt, and then returned and attached to the other clip on the same side to form a wire loop. The second wire is attached to one clip on the opposite side of the cabinet's vertical side and is passed under the sink's bowl, attached to a draw bracket and then returned and attached to the other clip on the same side (forms a second wire loop). The wire loops cradle the underside of the sink's bowl(s) with the draw bolt and draw bracket, joining the two side wire loops together. Silicon is applied to the sink's rim flange, and the draw bolt (attached to the draw bracket) is then turned to tighten the two wire loops, pulling the sink into contact with the underside of the countertop. Alternatively, silicon is applied to the sink's rim flange and the sink is lifted into position and aligned with the countertop cut out. One or two clamps are then passed through the sink's drain hole(s) (drain(s) not fitted) which grab the underside of the sink while the top jaw(s) of the clamp(s) grab the topside of one or two pieces of lumber placed across and overlapping the countertop's cut out. The clamp(s) is/are tightened, holding the sink in place. The draw bolt is then tightened and the clamp(s) is/are removed.

The main advantages of this mounting harness are: the sink can easily be lowered to replace the silicon joint; the entire portion of the sink's rim flange is in contact with the underside of the countertop; weight can be transferred from the countertop to the cabinet's sides; low manufacturing cost; it is simple to install; it will fit most types and size of sinks; and it is rated to carry a maximum of 250 lbs. However, the problem with this design is that the tensioned wires tend to pull the cabinet's sides in towards the sink, distorting the cabinet's sides, especially if the sides are manufactured from particle board.

Another cause for concern with the use of the mounting harness is how much support it achieves at the center of long double and triple-bowl undermount sinks. Most double and triple-bowl undermount sinks are manufactured with individual bowls that are joined at the top by the rim flange. The bottom of the bowls on high quality sinks are generally tied together using flat metal stripping which stiffens the sink and reduces flexing (longitudinal bending). Bowls that are not tied together will require greater support to reduce flexing to an acceptable level. As noted above, the harness' wire loops located at both ends of the underside of the sink's bowls are attached to the side clips and are not completely parallel (vertical) to the cabinet's vertical sides, causing weight from the sink and countertop to pull the cabinet's sides in towards the sink. The wires attached to the clips provide most of the vertical force that holds the sink to the underside of the countertop when the wires are put under tension. The wires under the sink's bowls are parallel to the sink's top rim flange. This parallel tension tends to pull the sink's outer bowls in towards the center of the sink, which causes the sink's rim flange to deflect upwards in its middle section, especially if the bowls are not tied together. When the sink is loaded, the middle section will tend to drop as the horizontal wires provide very little, if any, vertical support, causing the silicon joint to flex and delaminate. The present invention solves this problem by supporting 100% of the sink's rim flange on all four sides.

Another cause for concern when using the mounting harness comes when tightening the draw bolt. The sink can be raised too far and lift and damage the countertop, and/or the harness assembly. Another potential problem with the harness is the transmission of sound through the tensioned harness wires connected to the cabinet's box structure by the four clips. The cabinet can, in some cases, amplify the sound generated by the sink.

Accordingly, it is an object of the present invention to provide additional support to a countertop, especially when using box-style cabinets.

It is another object of the invention, with dishwasher installations, where the span between the cabinet's vertical walls is approximately 24-inches, to support the countertop located over the dishwasher as the dishwasher cannot make contact with the countertop.

It is still another object to provide a structural support for a countertop and a drop-in electric or gas cooktop insert that requires a large cut-out in the countertop of generally 30-inches to 44-inches in length.

It is a further object, with bathroom vessel sink installations, where the span between the cabinet's vertical walls can be up to 36-inches or more, to support such a countertop and vessel sink, particularly when used with the latest European 1-cm or 2-cm thick countertops that require extra support when mounting heavy natural stone vessel sinks.

SUMMARY OF THE INVENTION

The objects mentioned above, as well as other objects, are solved by the present invention, which overcomes disadvantages of prior sink support structures, while providing new advantages not previously associated with them.

The present invention provides a mechanical support structure that eliminates most of the problems identified above.

The support structure of the present invention is designed to support the sink and also provide support for the countertop at the sink's location, which is the countertop's weakest point.

The present invention allows manufacturers to produce, for example, triple-bowl enameled cast iron undermount sinks, as the support structure is designed to support over 500 lbs. at a span of 50-inches.

The present invention may be used to support the entire portion of the sink's rim flange on all four sides. Further, as the present invention only exerts a substantially downward (vertical) force into the cabinet's sides, the cabinet's sides are not substantially distorted, and the invention enables the support structure to be rated, for example, to carry a minimum of 500 pounds with a safety factor of 2.

The following outlines some useful features of the present invention:

14. The support structure can generally be installed before or after the installation of the countertop when using box style cabinets. Installing before is the preferred method as all installation is from above the cabinet.

15. The support structure's support frame assembly and sink can generally be installed as a complete assembly from the top or through the box style cabinet's front opening before the installation of the countertop. Installing from above the cabinet is the preferred method.

16. The support structure's support frame assembly and sink can generally be installed as a complete assembly through the box style cabinet's front opening after the installation of the countertop.

17. The undermount sink's rim flange may be supported on all four sides, preferably with complete contact with the support frame assemblies' four frame rails, resulting in very little rim flange flex. The frame rail's profile may be designed using CAD (computer aided design) stress analysis to reduce bending moments, thereby reducing deflection in the frame rails, especially when the sink is fully loaded.

18. The support frame assembly can be used to compress the silicon joint (once it has cured), located between the sink's rim flange and underside of the countertop, thereby reducing the possibility of delamination, which allows the rapid growth of bacteria and mold.

19. The support frame assemblies' frame rails may be isolated from the sink's rim flange by Sorbothane® visco-elastic polymer vibration dampening/shock absorbing strips, thereby reducing the sound generated by the sink from being transmitted to the cabinet. (High quality sinks are sprayed on the outside with sound-deadening material to reduce noise emission, retain heat and reduce condensation.)

20. The support frame assembly (four rails) can be attached to the sink unit before installation into the cabinet, allowing the complete assembly to be raised and lowered in the cabinet, thereby reducing assembly and future maintenance time.

21. The support frame assembly supports both the sink or cooktop, and the countertop, thereby reducing stress on the weakest part of the countertop.

22. The side brackets (two types, one and two slot) may be designed to be mounted against the cabinet's vertical sides and flush to the vertical side's top surface. The mounting holes may be slotted and designed to index with the European hinge/shelf mounting holes already pre-drilled in the cabinet's vertical sides.

23. The support structure's support frame assembly allows the sink to be partially lowered (after cutting through the silicon joint and removing the drain's plumbing) when the silicon joint between the sink's top rim flange and the countertop becomes contaminated with bacteria and mold.

24. The support frame assembly and sink can be quickly and fully lowered and/or removed as an assembly (after cutting through the silicon joint and removing the drain's plumbing).

25. The support structure's support frame assembly can be adapted to provide additional support to a countertop, especially when using box-style cabinets for dishwasher installations, and electric or gas cooktop inserts that require a large cut out in the countertop of generally 30-inches to 44-inches.

26. The support structure's support frame assembly can be adapted to provide additional support to a bathroom countertop and heavy vessel type sinks, especially when using wide box-style cabinets with 1-cm and 2-cm thick countertops.

In a preferred embodiment of the invention, an undermount support is provided for an appliance (such as kitchen and bathroom sinks, dishwashers and countertop cooktops) having a rim flange around at least a portion of its exterior. The undermount structure may include a frame that is: (a) assembled around the exterior periphery of the appliance; (b) located in supporting contact below the underside of the rim flange of the appliance; and (c) attached to cabinetry adjacent the appliance. The cabinetry at least partially supports the countertop or cooktop, and the frame thereby enables the cabinetry to at least partially support the appliance by the rim flange.

The sink may be a single, double or triple-bowl kitchen sink or single-bowl bathroom sink. In a particularly preferred embodiment, the frame may include frame rails that can be assembled to form an assembled frame. As a non-limiting example, the assembled frame may be rectangular in shape and may include two opposing longitudinal frame rails with and two opposing cross frame rails. A plurality of side support brackets may be used to attach the frame to adjacent cabinetry.

In a preferred embodiment, each side support bracket may include a housing and at least one plate movable within the housing, thereby allowing the height of the frame to be adjusted to a plurality of different heights relative to a height of the adjacent cabinetry. In a particularly preferred embodiment, each side support bracket may include a top ramp plate, and a bottom ramp plate; these plates may be configured in a plurality of positions relative to each other and to the side bracket housing to allow a height of the frame to be adjusted to a plurality of different heights relative to a height of the adjacent cabinetry. Either or both of the top and bottom ramp plates may include a cutout or slot for receiving a portion of the frame.

The undermount structure of the present invention may be advantageously used with a variety of different style cabinets, including but not limited to modular and European-style box cabinets.

In a preferred embodiment, the frame continuously supports an underside of the rim flange of the appliance. Vibration-dampening/shock-absorbing strips, which may be visco-elastic, may be attached to the under side of the rim flange, thereby reducing sound generated by the sink from being transmitted to the cabinet.

Preferably, the frame exerts only a substantially vertically downward force on the adjacent cabinetry, thereby limiting distortion of sides of the cabinetry that may be otherwise caused if substantially horizontal forces exerted on the cabinetry sides.

Preferably, the frame rails are designed using CAD-stress analysis. This facilitates a frame rail design in which the frame rails have built-in camber to reduce deflection. In an alternative embodiment, the frame rails may be designed so that they change in cross-sectional area over their length, to reduce deflection.

It will be appreciated that the undermount structure support frame assembly can be used to compress the silicon joint (once it has cured), located between the sink's rim flange and underside of the countertop.

The frame may also include a plurality of splayed frame rails that are adjustable in length, and two double-slotted side support bracket assemblies that support a span of otherwise unsupported countertop, located between two vertical supports or vertical cabinet sides.

A plurality of side brackets may be used which are attachable to the frame, and also attachable to the cabinetry. The side brackets may have one or more slots enabling the frame to be separately assembled from the side brackets, and further enabling the assembled frame to be attached or detached from the side brackets.

A method for installing an undermount structure also forms part of the present invention. An undermount structure is provided which includes frame members; the undermount structure may be attached to an appliance having a rim flange around its exterior, permitting the appliance to be mounted to adjacent cabinetry supporting a countertop. In this preferred method, the frame members may be assembled around the exterior periphery of the appliance, so that the frame members are located beneath and in supporting contact against an underside of the rim flange of the appliance. The undermount structure can now be attached to cabinetry adjacent the appliance, so that the frame permits the cabinetry to support the appliance by the rim flange.

The assembly step can occur before or after a countertop or cooktop is installed. Thus, the assembly of the undermount structure and the appliance may be inserted from a top of the cabinetry or through a front opening of the cabinetry prior to attachment of the assembly to the cabinetry. Alternatively, the assembled undermount structure and appliance may be inserted through a front opening of the cabinetry after the countertop has been first installed to the cabinetry. It will be appreciated that the undermount structure may be used to compress a silicon joint located between the rim flange of the appliance and an underside of the countertop.

It will also be appreciated that a countertop cooktop is a drop-in unit and the underside of its rim flange or glass top sits on top of the countertop. The topmount support structure supports the underside of the countertop's cooktop cutout. Thus, it is only the undermount sinks that the support frame assembly attaches to.

Definition of Claim Terms

The terms used in the claims of the patent are intended to have their broadest meaning consistent with the requirements of law. Where alternative meanings are possible, the broadest meaning is intended. All words used in the claims are intended to be used in the normal, customary usage of grammar and the English language.

"Appliance" means sinks, including single-, double- and triple-bowl/vessel kitchen and bathroom sinks, dishwashers, countertop cooktops, or other appliances that may need support when built into cabinetry.

"Undermount" means an appliance that is located (mounted) under a countertop and supported by the underside of its rim flange with the top of the rim flange located adjacent to the underside of the countertop. Generally silicon sealant is installed between the rim flange's top surface and the underside of the countertop.

"Topmount" (drop-in) means an appliance that is located (mounted) on top of a countertop and supported by the underside of its rim flange or glass top. Generally a foam gasket is installed between the rim flange or glass top and the top of the countertop.

BRIEF DESCRIPTION OF THE DRAWINGS

The novel features which are characteristic of the invention are set forth in the appended claims. The invention itself, however, together with further objects and attendant advantages thereof, can be better understood by reference to the following description taken in connection with the accompanying drawings, in which preferred embodiments of the present invention are shown and now described:

FIG. 8*a* is an end view of sink 3 and the support structure assembly 4 and shows the side support bracket assemblies (single slot) 5, longitudinal frame rails 6, cross frame rails 7, Sorbothane® visco-elastic polymer vibration dampening/shock absorbing strips 10, thumb screws 8 and side support bracket attachment screws 11.

FIG. 8*b* is an enlarged perspective view of the circled region in FIG. 8*a*, and shows longitudinal frame rails 6 inserted into one of the side support bracket assemblies.

The components in the drawings are not necessarily to scale, emphasis instead being placed upon clearly illustrating the principles of the present invention. In the drawings, like reference numerals designate corresponding parts throughout the several views.

DETAILED DESCRIPTION OF THE PRESENT INVENTION

Figure 1A:
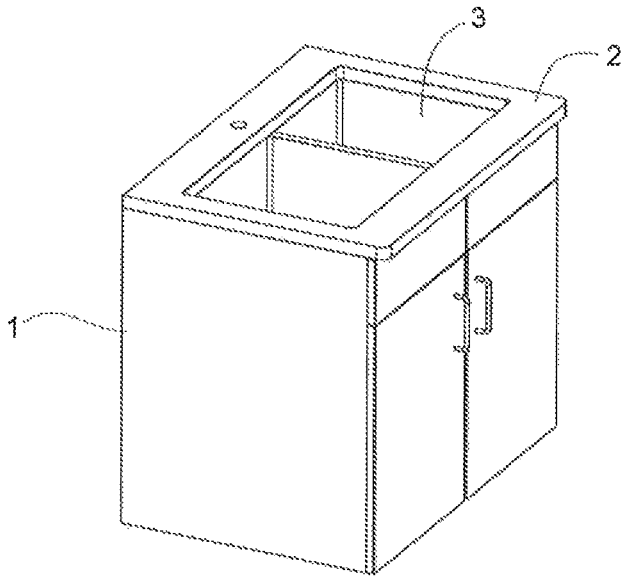
FIGS. 1*a* and 1*b* are perspective views of preferred embodiments of the present invention, showing a stand-alone kitchen sink installation and an integrated sink installation, respectively, using European-style box cabinets 1, countertop 2 and sink 3. European-style box cabinets are preferably a modular design that can be assembled side-by-side to form a counter or island.

Set forth below is a description of what are believed to be the preferred embodiments and/or best examples of the invention claimed. Future and present alternatives and modifications to this preferred embodiment are contemplated. Any alternatives or modifications which make insubstantial changes in function, in purpose, in structure, or in result are intended to be covered by the claims of this patent.

The present invention relates to a support structure used to support countertops, and install and support all types and shapes of undermount sinks and drop-in gas and electric cooktops typically found in new residential kitchens. It is especially advantageous for use with larger (heavier) single or double kitchen sinks which fit into European-style box cabinets, such as those that are approximately 36-inches wide.

The present invention may also be used to install and support any type of kitchen triple-bowl undermount sink with a top rim flange, while also supporting the countertop. All that is required is a wide cabinet and/or two, strong vertical supports, to which the four side support bracket assemblies can be attached.

As noted before, triple-bowl undermount sinks are approximately 40-inches to 48-inches wide and require substantial support when fully loaded, especially cast iron sinks. The support structure is designed to support over 500 pounds at a span of 50-inches.

It is not recommended to attach long double or triple-bowl sinks directly to the underside of the countertop, as the large opening required for the sink and faucet hole(s) weakens the countertop. As an example, a double-bowl sink requires a rectangular cut-out in the countertop of 17.00-inches×30.75-inches. The recommended countertop width is approximately 26-inches for box-style cabinets. This leaves only 4.50-inches of width (front and back) at the sink opening. The back 4.50-inches width is further weakened when holes are cut (generally one or three holes) to mount the faucet. A single handle faucet requires one 1.375-inches diameter hole, while a two-handle faucet requires three 1.375-inches diameter holes spaced at 4-inches apart. Most installers will cut the faucet holes after the countertop has been laid, to reduce the chance of the countertop cracking during transportation and installation.

As noted above, the support frame assembly of the support structure of the present invention can be adapted to provide additional support to a bathroom countertop and heavy vessel type sinks, especially when using wide box-style cabinets with 1-cm and 2-cm thick countertops.

With box-style cabinets, the present invention's support structure allows the sink to be installed before or after the countertop is installed.

The support structure allows the sink to be partially or fully lowered when the silicon joint eventually becomes contaminated with bacteria and mold (after cutting through the silicon joint located between the sink's top rim flange and underside of the countertop and removing the drain's plumbing). Enough working space is provided when the sink is partially lowered, allowing all of the old silicon to be removed and the adjoining surfaces to be properly cleaned with denatured alcohol before reapplying fresh, silicon sealant. If the sink is to be only partially lowered, and the sink's drain or drains are plumbed with a slip joint, and the joint allows sufficient travel, the slip joint only needs to be loosened, and the plumbing does not have to be disconnected or removed. It is generally recommended that the silicon joint be replaced approximately every 3-5 years.

Countertops are generally fabricated using quartz, granite or marble. The slabs are either 1.18-inches (3-cm) or 0.78-inches (2-cm) thick. 3-cm countertops are generally attached directly to the cabinet's top surfaces with silicon adhesive. It is generally recommended that 2-cm countertops be laid over and bonded to a 0.75-inches substrate such as plywood. The substrate adds strength and assists in producing a flush seam (joint) when joining sections of the countertop. This works well for drop-in sinks and cooktops as the substrate is below the countertop with the sink's rim flange and the cooktop sitting on top of the countertop. However, it does not work with undermount sinks as the substrate would be located between the sink's rim flange and the underside of the countertop. This would expose the substrate to water.

The present invention allows the largest of undermount sinks and cooktops to be used with 2-cm thick countertops, as the support frame assembly supports the sink, cooktop and the countertop. This allows the 2-cm countertop to be directly attached to the cabinet's top support surfaces using silicon adhesive. The trend in Europe is toward 1-cm thick countertops which provide a sleek and modern look, with all of the appliances hidden from view. The present invention is well-suited for any future 1-cm or less in thickness countertops.

It will be understood that use of the present invention provides the following advantages:

4) When using European-style box cabinets (frameless), the support frame assembly (four rails) can be attached to the sink, allowing the frame rail assembly and sink to be installed as a unit into the cabinet, which reduces assembly time and allows the sink to be installed before or after the countertop is installed.

5) The support structure allows the sink to be partially lowered or fully lowered and/or removed without removing the countertop or cabinets.

6) Transmission of sound through the support structure to the cabinet's box structure has all but been eliminated by the use of Sorbothane® visco-elastic polymer vibration dampening/shock absorbing strips.

In the following detailed description of the present invention, a European-style box cabinet (frameless) and a double-bowl kitchen sink have been used as an example, but it will be understood that various other cabinet designs, and other sinks (single and triple-bowl kitchen sinks, bathroom sinks, and other sinks as mentioned above) may be used with the present invention.

Figure 1B:
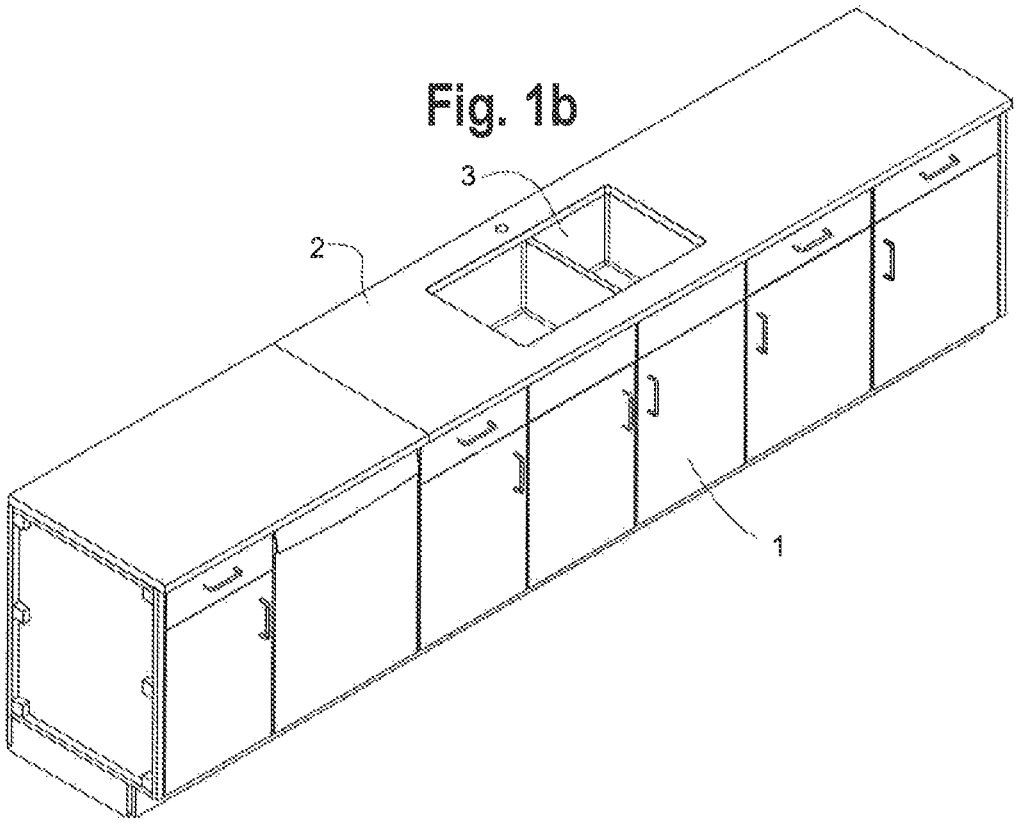

Referring now to FIGS. 1*a* and 1*b*, European-style box cabinets (frameless) 1 may be a modular design that can be assembled as a stand-alone kitchen sink installation 1*a* or as an integrated sink installation 1*b*. Box cabinets can be assembled side-by-side and may be joined together by screw fasteners using the predrilled holes (FIG. 6A) in the cabinet's vertical sides. Countertop 2 and sink 3 are supported by the vertical sides of the boxes. When two cabinet boxes are joined together, the total thickness of the two vertical supports may be approximately 1.5-inches. The span between the vertical sides generally offers little structural support, as the front of the box is open to accommodate either doors or sliding drawers. The back of the box may be closed in with a (e.g.) ⅛-inches fibre board, may be nailed on with finishing nails, and may not be able to add very much structural support. This does, however, keep the box square for assembly. As noted above, the weakest section of countertop is where the sink and faucet cut-outs are located, which is between the cabinet's vertical supports (approximately a 36-inches wide span with a double sink), which offers very little structural support.

Figure 2:
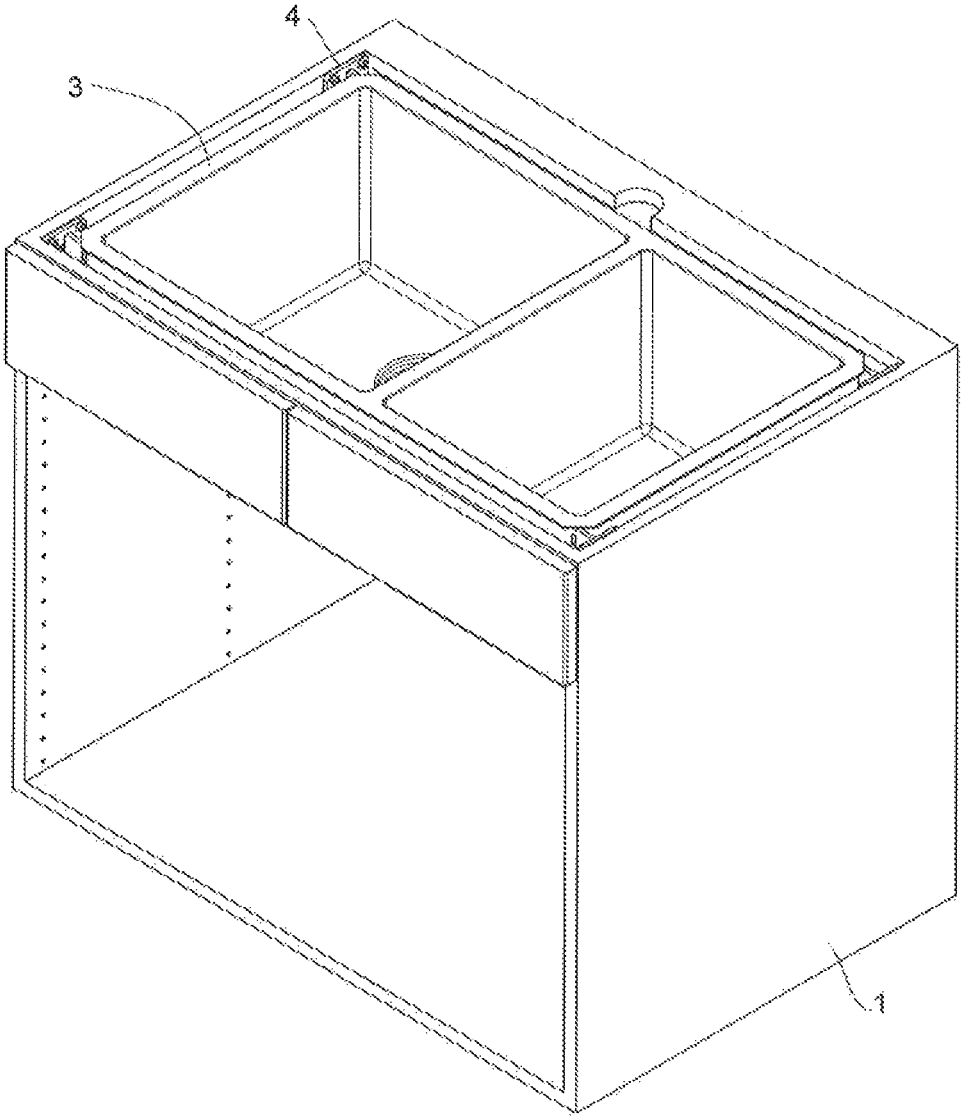
FIG. 2 is a perspective view of a stand-alone kitchen sink installation using a European-style box cabinet 1 with the countertop 2 removed. Sink 3 may be suspended by support structure assembly 4 of the present invention. The front doors of the cabinet are removed for clarity.

Referring now to FIG. 2, a stand-alone kitchen sink installation is shown, with the countertop 2 and front doors removed for clarity. The double sink 3 is supported by the support structure assembly 4 of the present invention. The present invention works particularly well with the box cabinet's design with its clean, unrestricted sides (frameless). To remove (drop down) the sink 3 and support structure 4 as an assembly (countertop installed), the front doors, door hinges, shelves (if fitted) and drain plumbing must be removed. This allows the sink and the support structure assembly (one unit) to be lowered and removed through the front opening of the cabinet. Retrofits are also possible using the present invention, especially when box cabinets are already installed. Water and drain plumbing might have to be modified to allow for support structure clearance.

Figure 3A:
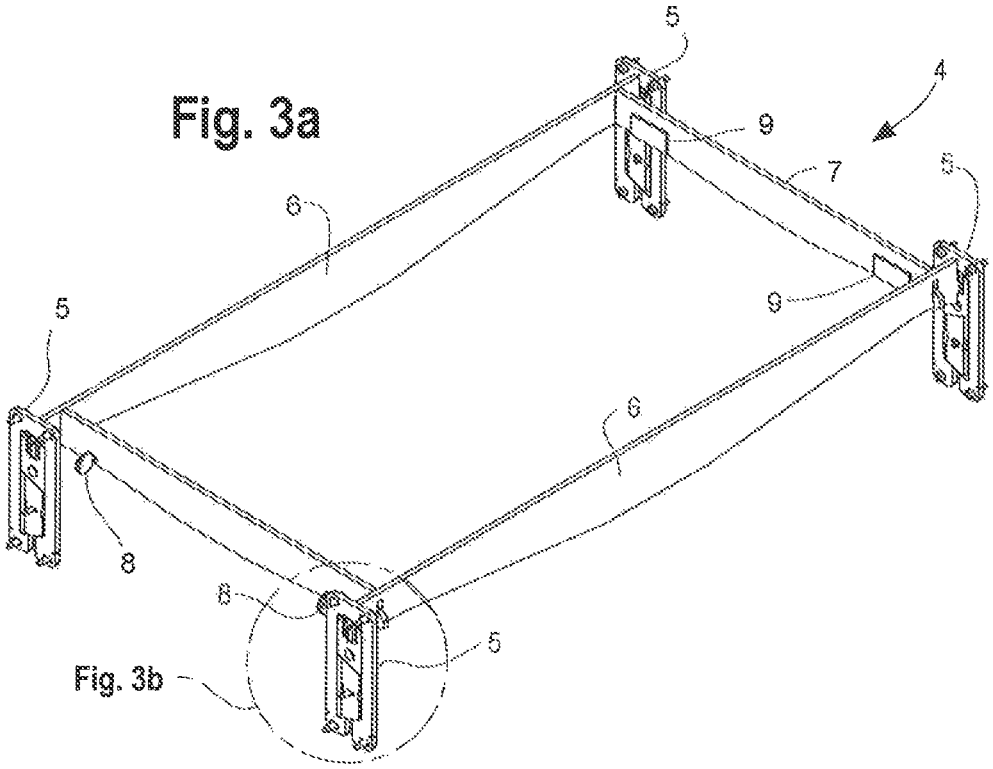
FIG. 3*a* is a perspective view of support structure assembly 4 of the present invention, showing the two different side support bracket assemblies 5, longitudinal frame rails 6, cross frame rails 7, thumb screws 8 (only two of four visible on each assembly) and single-sided adhesive rubber pads 9 (only two of four visible on each assembly)
Figure 3B:
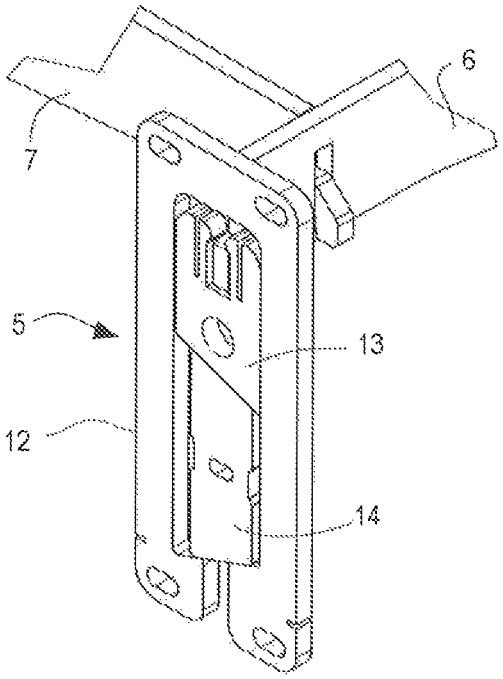
FIG. 3*b* is an enlarged perspective view of the circled region of FIG. 3*a*.
Figure 3C:
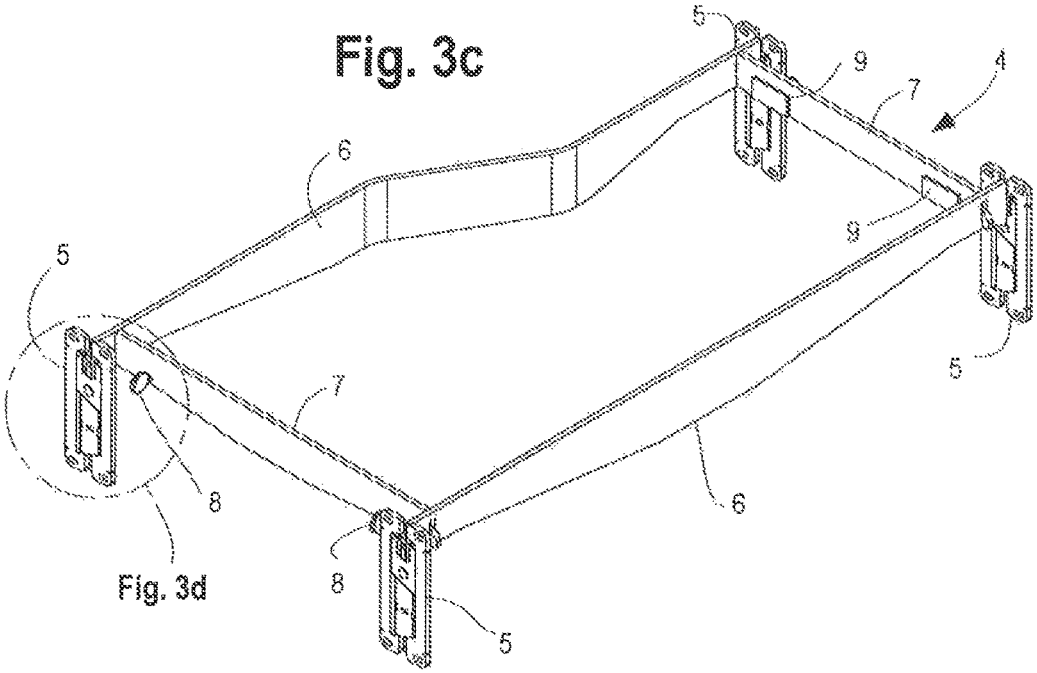
FIG. 3*c* is a perspective view similar to FIG. 3*a*, but utilizing a different support structure assembly for a differently-shaped double sink.

FIGS. 3*a* and 3*c* show two different support structure assemblies 4. The FIG. 3*a* embodiment may be employed with single, double and triple-bowl sinks which have their bowls in line and at the same width. The FIG. 3*c* embodiment may be employed with double sinks with bowls that have different widths/shapes.

Figure 3D:
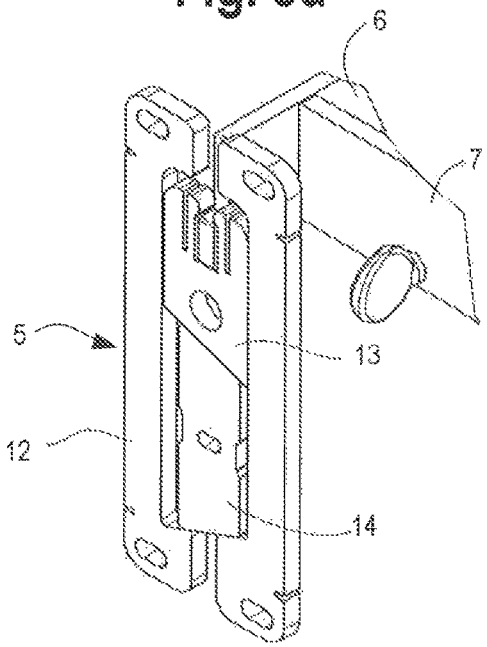
FIG. 3*d* is an enlarged perspective view of the circled region of FIG. 3*c*.
Figure 4A:
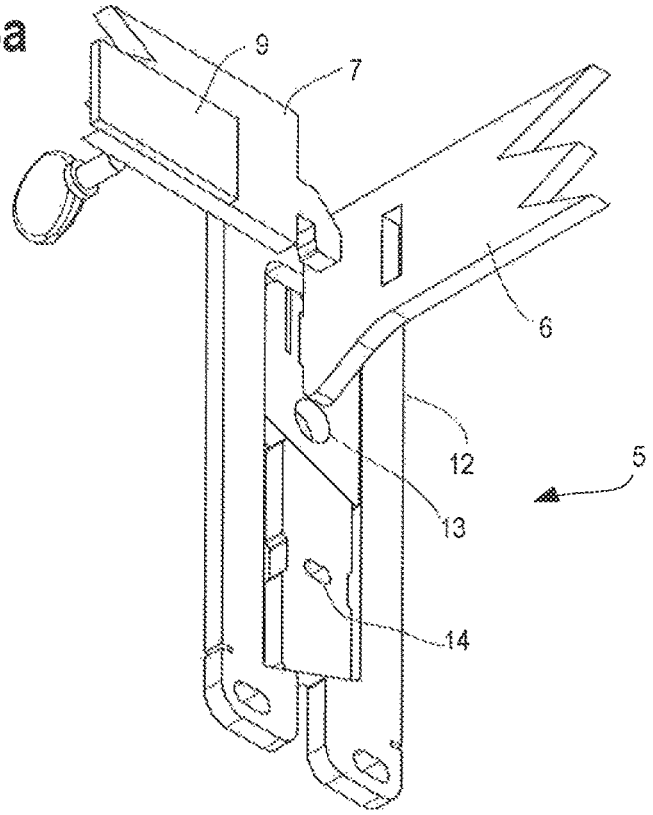
FIGS. 4*a* and 4*b* are two perspective views.
Figure 4B:
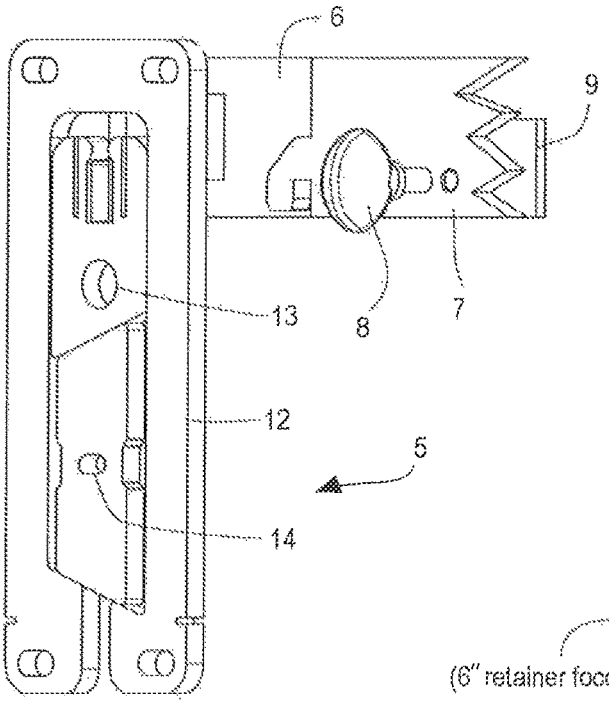
Figure 4C:
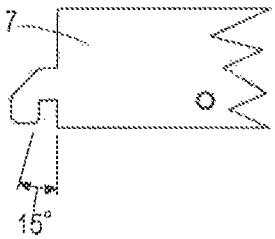
FIGS. 4*c* and 4*d* are two end views, showing one of the side support bracket assemblies (single slot) 5, which includes housing 12, top ramp plate 13 and bottom ramp plate 14. Longitudinal frame rail 6 and cross frame rail 7 are shown (FIGS. 4*c* and 4*d*) with their slots and tangs.
Figure 9A:
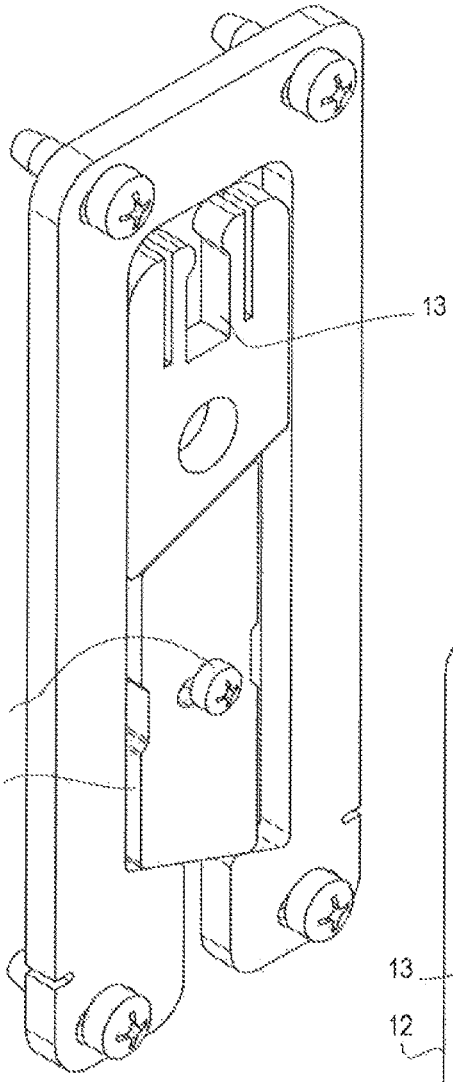
FIGS. 9*a*, 9*b* and 9*c* are side, end and front perspective views, respectively, showing one of the side support bracket assemblies 5, which includes housing 12, top ramp 13, bottom ramp 14 and optional bottom ramp retaining screw 75.
Figure 9B:
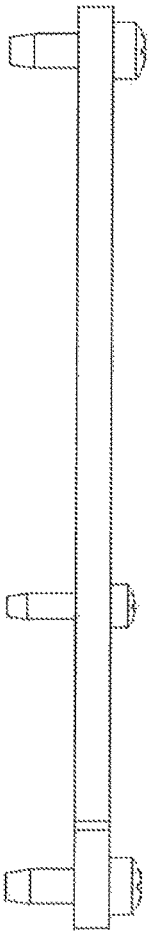
Figure 9C:
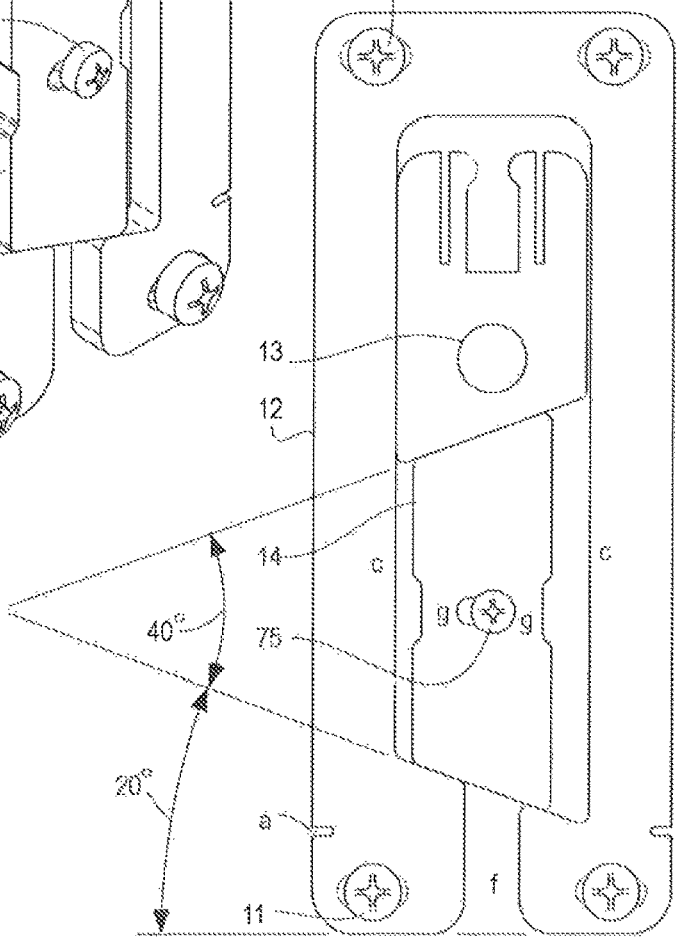

FIG. 3*b* shows a side support bracket assembly 5 with one bottom slot in the housing plate 12, as shown later in FIGS. 4*a* and 4*b*. FIG. 3*d* shows a side support bracket assembly 5 with two slots (top and bottom) formed by two housing plates (left and right hand) 12, as shown later in FIG. 12. Both types of side support bracket assemblies 5 may be fitted with identical parts, except for the housings 12. In this embodiment, the other parts of the support structure are: the longitudinal frame rails 6, cross frame rails 7, thumb screws 8 (only two of four visible) and single sided adhesive rubber pads 9 (only two of four visible), which when assembled form the support frame assembly. Items 5, 6 and 7 of the prototype are preferably CNC water jet cut from 6061 aluminum. The only machining involved in the manufacturing process is the four tapped holes in the cross frame rails 7 (two in each cross frame rail) for the thumb screws 8. CNC water jet cutting reduces fabrication cost, assures accuracy and produces a non-slip surface finish on the 20-degree ramps as shown FIGS. 9*a*-9*c*. Longitudinal frame rails 6 each have two or more slots. Cross frame rails 7 each have tangs at both ends (only one end shown) as shown in FIGS. 4*a* and 4*c*. The tangs are tapered (15-degrees) and provide an interference fit, when they are driven into the slots in the longitudinal frame rails 6 using a hammer and block of hardwood. This provides a rigid and square frame assembly with flush top surfaces. The longitudinal frame rails 6 are capable of supporting the largest and heaviest triple-bowl undermount sinks, with very little deflection. Using stress analysis, the frame rail's profile can be custom-designed by changing its cross-section and/or by adding positive camber into the top surface to almost eliminate deflection when the sink is fully loaded.

Although CNC water jet cut 6061 aluminum was used in the prototype, steel or composites could be used instead of the aluminum. Various shaped single, double and triple-bowl sinks can be accommodated by varying the design of the longitudinal frame rails 6, and cross frame rails 7 as seen in FIGS. 3*a* and 3*c*. Some double and triple-bowl sinks have enough space between the sink's bowls (see FIG. 5) that additional cross frame rails can be incorporated into the design. The additional cross frame rails would not make contact with the sink and would only be used to tie the two longitudinal frame rails 6 together, adding greater rigidity to the longitudinal frame rails.

It would also be possible to design the longitudinal frame rails 6, and cross frame rails 7 to be adjustable in length by splitting each frame rail into two pieces. Longitudinal slots (in one or both pieces) and screw fasteners would hold the rails together and also allow them to slide. This, however, would increase the manufacturing costs and the installation setup time.

Once the longitudinal frame rails 6 and cross frame rails 7 have been fitted together, the four thumb screws 8 and four single-sided adhesive rubber pads 9 may be installed. With the sink 3 positioned upside down, the complete support frame assembly can be permanently attached to the sink 3, once the four Sorbothane® visco-elastic polymer vibration dampening/shock absorbing strips 10 (see FIGS. 5-10, only two visible) have been attached to the underside of the sink's rim flange. Sorbothane® is sticky and will hold itself in place while the frame is being attached. For production the Sorbothane® could be manufactured as a "U" channel and slipped over the cross and longitudinal frame rail's top supporting edges, as shown later in FIG. 14.

Figure 5:
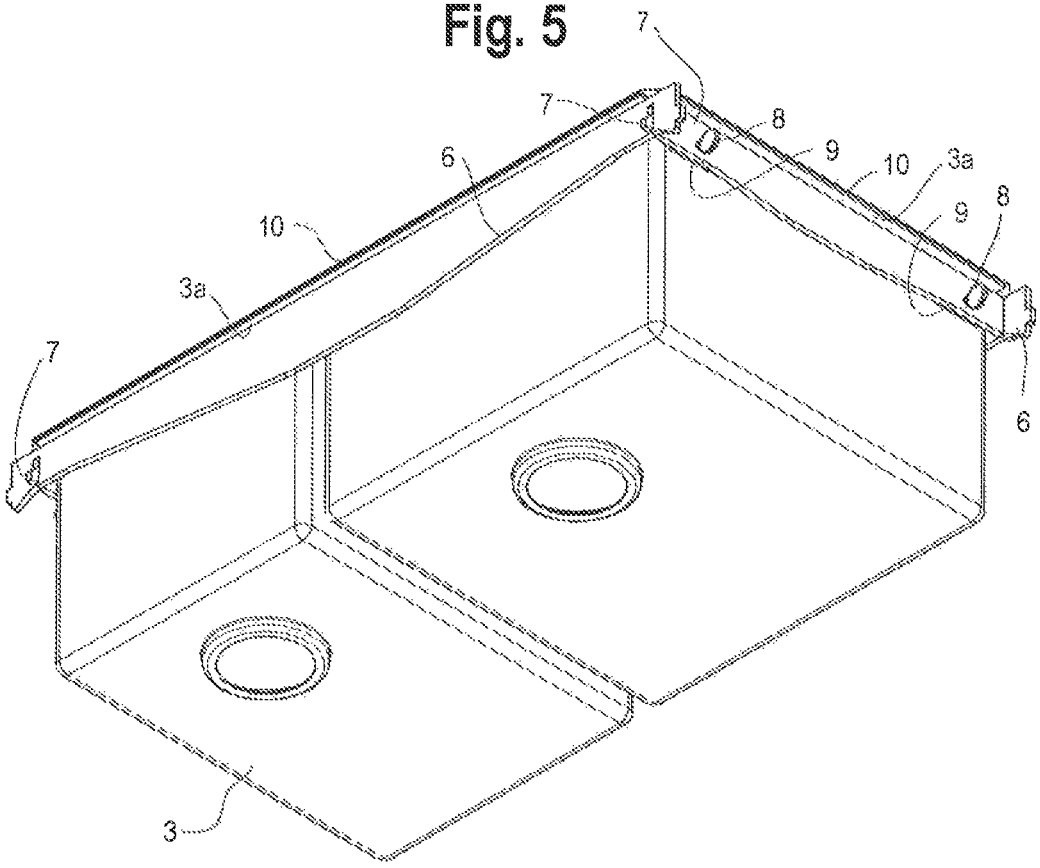
FIG. 5 is a perspective view of the present invention and shows the support structure assembly's longitudinal frame rails 6, cross frame rails 7, thumb screws 8 (only two of four visible), single-sided adhesive rubber pads 9 (only two of four visible) and Sorbothane® visco-elastic polymer vibration dampening/shock absorbing strips 10 (two of four visible) attached to a double-bowl sink 3.

The four thumb screws 8 hold the support frame assembly and sink together. The thumb screws are turned in (with the sink in place) and push the single-sided adhesive rubber pads 9 on to the sink bowl's two vertical end walls. The adhesive is only used to initially hold the pads to the frame rails until the screws bite into the rubber. The single-sided adhesive rubber pads are an option if the sink has been sprayed with sufficient thickness of sound-deadening material, as the thumb screws will bite directly into the sound-deadening material. The four thumb screws 8 require very little pressure to hold the support frame assembly and sink together and do not provide enough force to damage the sink. A secondary function of the four thumb screws is to provide minor adjustments to square the support frame assembly to the sink. FIG. 5 shows the assembled sink and support frame assembly, ready for installation into a box cabinet.

Figure 10A:
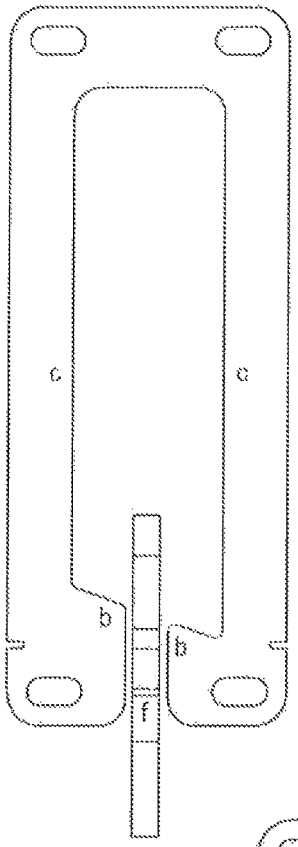
FIGS. 10*a*, 10*b*, 10*c* and 10*d* are front perspective views showing one of the side support bracket assemblies 5 shown in four positions (positions A, B, C and D).
Figure 10B:
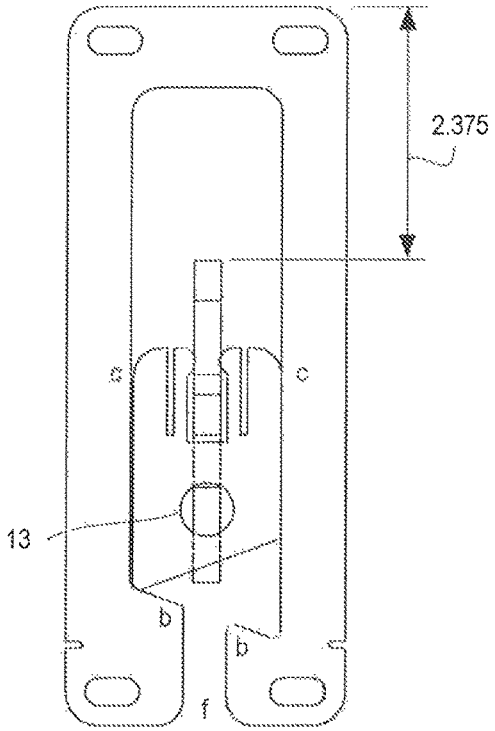
Figure 10C:
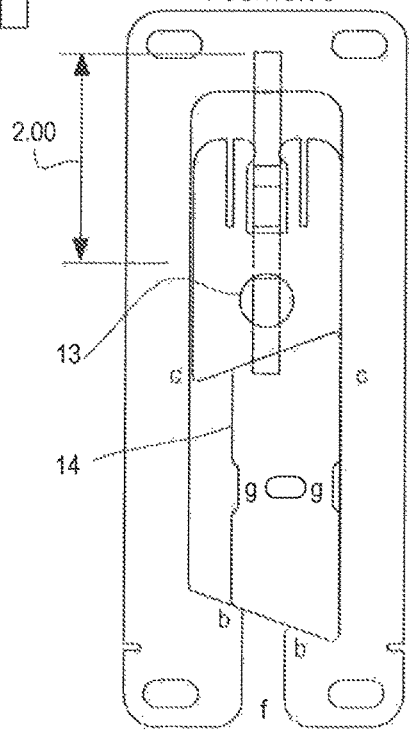
Figure 10D:
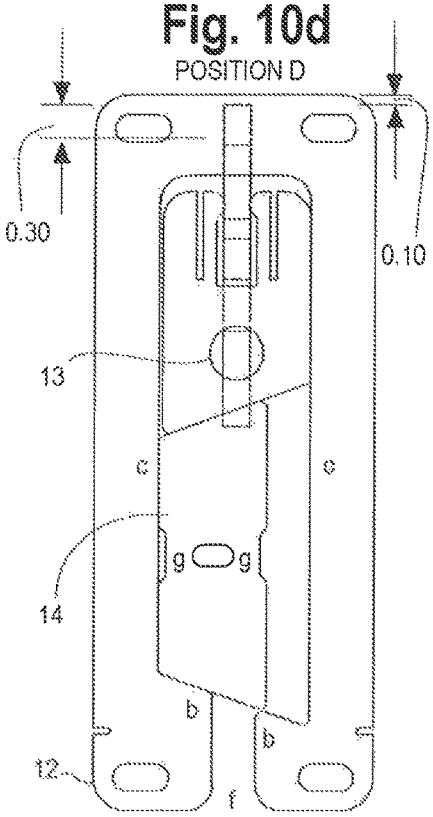

For new construction (countertop not in place) it may be easier to mount the four side support bracket assemblies 5 (single lower slot design) to the box cabinet's vertical sides and install the assembled support frame assembly from below, through the cabinet's front opening. The support frame assembly may then be raised into the side support bracket assemblies 5, and the four top ramp plates 13 (see FIGS. 9-13) may be attached to the two longitudinal frame rails 6 as shown in FIG. 10*b*, POSITION B (ramp plates 13 sit on the lower ramp of housings 12). The support frame assembly's top surface would be approximately 2.375-inches below the cabinet's top surface. Installing the four bottom ramp plates 14 as shown in FIGS. 10*c* and 10*d*, Positions C and D, respectively, allows the support frame assembly's top surface to sit between approximately 0.10-inches to 0.30-inches below the cabinet's top surface. Sorbothane® strips 10 may be attached to the underside of the sink's rim flange, and the sink may be lowered into position from above, on to the support frame assembly. At the 0.10-inches setting (FIG. 10*d*, Position D) the sink would be approximately 1/16-inches above the level of the cabinet's top surface due to the thickness of sink's rim flange and the Sorbothane® strips. The sink can now be aligned with the cabinet and the thumb screws tightened.

If the side support bracket assemblies 5 are of the two slot design, the complete support frame assembly and sink can be installed from above (countertop not installed), or from below. When installing the complete support frame assembly and sink from above, the four bottom ramp plates 14 and the four top ramp plates 13 may be installed in the side support brackets 5, and temporarily held in place with duct tape. The complete support frame assembly and sink may then be then lowered down through the side support bracket's 5 top slots until the two longitudinal frame rail tangs 6 (FIG. 4*d*) snap into the four top ramp plates 13.

Figure 6A:
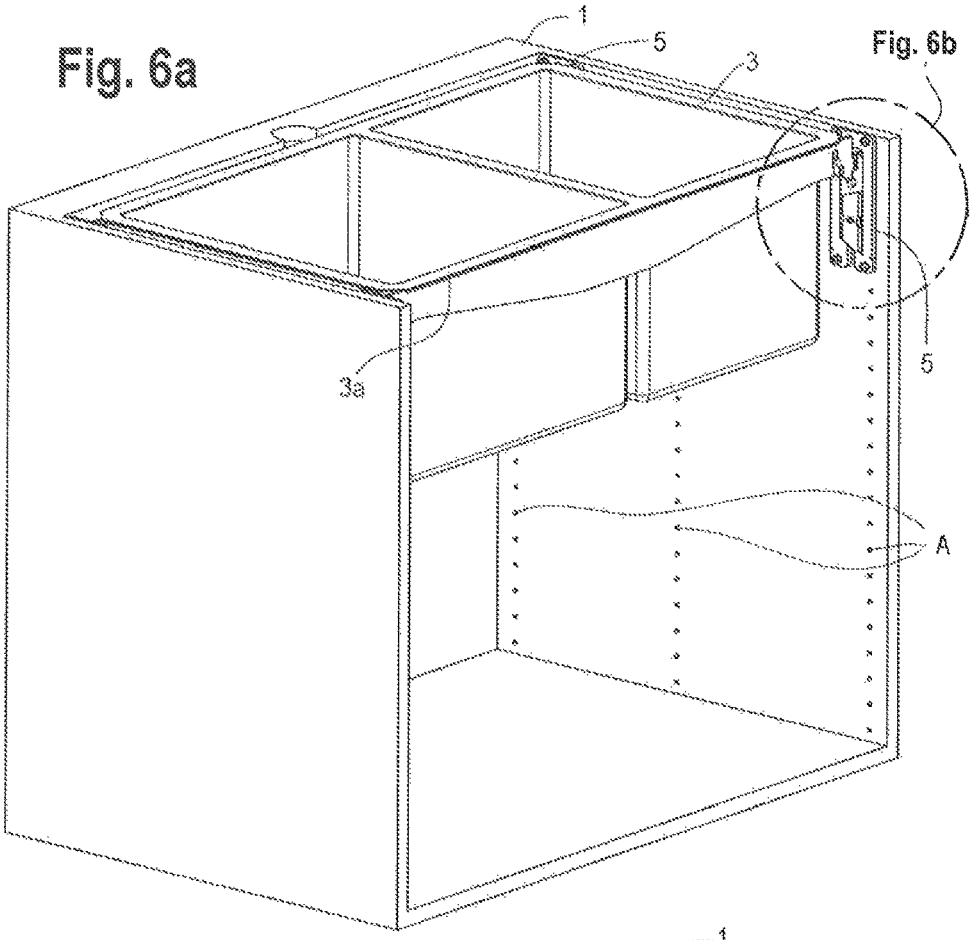
FIG. 6*a* is a perspective view of the box cabinet 1 (front removed) and shows the side support bracket assemblies 5, longitudinal frame rails 6, cross frame rails 7, Sorbothane® visco-elastic polymer vibration dampening/shock absorbing strips 10 and side support bracket attachment screws 11.
Figure 6B:
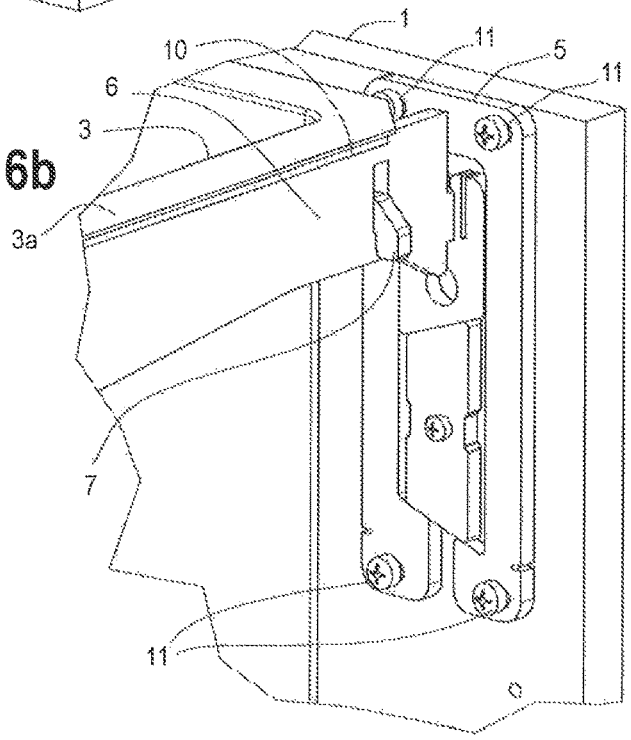
FIG. 6*b* shows one of the side support bracket assemblies 5 mounted flush to the box cabinet's 1 vertical side, top surface by four attachment screws 11 located in slotted holes. The slotted holes line up with the hinge/shelf pre-drilled holes A located in a vertical pattern at opposite sides of the box cabinet's vertical sides.
Figure 7A:
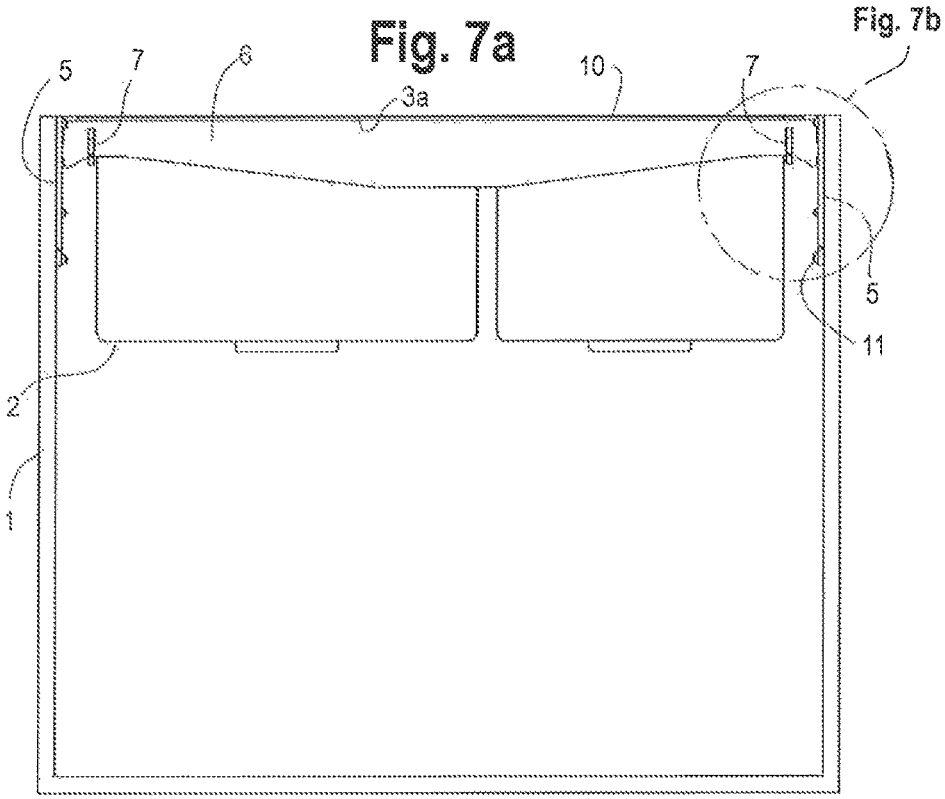
FIG. 7*a* is a front view of the box cabinet 1 (front and doors removed) and shows the side support bracket assemblies 5, longitudinal frame rails 6, cross frame rails 7, Sorbothane® visco-elastic polymer vibration dampening/shock absorbing strips 10 and side support bracket attachment screws 11.
Figure 7B:
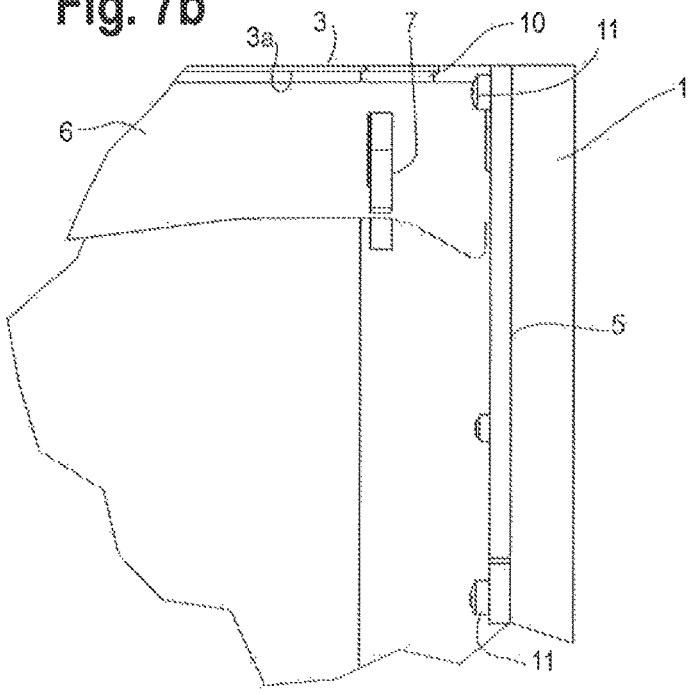
FIG. 7*b* is an enlarged perspective view of the circled region in FIG. 7*a*, and shows one of the side support bracket assemblies 5 mounted flush to box cabinet's 1 vertical side, top surface.

FIGS. 6 and 7 show the support structure assembly of the present invention, together with the sink and Sorbothane® strips mounted into a typical 36-inches wide box cabinet. The cabinet's front, doors and countertop are not installed in this example. The side support bracket assemblies 5 have slotted holes that are designed to line up with the hinge, and the shelf has predrilled mounting holes (FIG. 6A) located at opposite sides of the box cabinet 1. Four screws 11 attach side support bracket 5 to box cabinet 1. The slotted holes allow side support bracket assemblies 5 to be moved towards or away from the front face of the cabinets, and allow the sink to be accurately aligned with the open top of the cabinet and/or the countertop's cut out. Further adjustment is also possible using the four screws 8, as there is sufficient clearance between the frame rails and the sink's bowls.

The slotted holes of side support bracket assembly 5 are designed to fit 5-mm, Confirmat screws that act like steel dowels. These screws have a large shoulder under the head that fits into the bracket's slots with very little clearance, and have a course, large diameter thread that locks into the cabinet's sides (generally particle board). When European-style box cabinets are assembled side by side, 5×40-mm Confirmat screws can be used to attach the support bracket assemblies 5 to the cabinet's vertical sides. The screws also add extra rigidity to the cabinets by further tying the two sides together. FIG. 6*b*, shows one of the side support bracket assemblies 5 mounted flush to the box cabinet's top surface, allowing the installer to accurately and easily place and secure the brackets.

FIGS. 7 and 8 show the support structure assembly of the present invention, together with the sink and Sorbothane® strips. It can be seen that the sink's top flange is flush with the side support bracket's top surface and box cabinet's top surface. It is the side support bracket assemblies 5 that adjust the final height of the sink's top rim flange in relationship to the box cabinet's sides, adjusted by sideways movement of the lower ramp plate, as seen in FIGS. 9-14. If the sink installation requires a finished silicon bead thickness of 1/16-inches then the ramp mechanisms shown in FIGS. 9 and 10 may be adjusted by sideways movement (to the right) of the lower ramp plates (see FIGS. 9-14), which will lower the complete support structure 1/16-inches. A straightedge, spanning the cabinet's top support surfaces, may be used together with a 1/16-inches spacer (not shown), inserted between the straightedge and sink's rim flange, to set the clearance. A bead of silicon sealant may then be applied to the sink's top rim flange (approximately 3/8-inches in from the inner edge, on the bowl side). Silicon adhesive can also be applied at this time to the cabinet's vertical supports, top surfaces, securing the countertop to the cabinets. The countertop can then be lowered into position and the excess silicon removed from around the sink's flange. Once the silicon has set (generally 24 hours), the ramp mechanism can be used to slightly raise the support frame assembly and sink, compressing the set silicon around the sink's rim flange and transferring weight from the countertop to the support structure, thereby supporting the countertop at its weakest point.

As noted above, the support frame assembly and sink can be installed after the countertop is installed over the cabinet(s). With the side support bracket assemblies 5 (single slot type) mounted flush to box cabinet's top surface, the complete support frame assembly and sink may be raised by hand inside the cabinet and held in place within the four side support bracket assemblies 5, while the four top ramp plates 13 are attached to the two longitudinal frame rails 6 and the four bottom ramp plates 14 are installed (support frame assembly and sink in lowest ramp position, per FIG. 10*c*, POSITION C). Four 1/16-inches spacers (not shown) may then be positioned between the sink's top flange (laid on top of the sink's rim flange) and the bottom of the countertop. The four ramp plates 14 may then be adjusted (moved to the left) until the sink forces the spacers to make contact with the underside of the countertop. The spacers may then be removed and a bead of silicon added to the 1/16-inches gap, wiped clean, and allowed to set. Once the silicon has set (generally 24 hours), the ramp mechanism can be used to slightly raise the support frame assembly and sink, compressing the set silicon.

Alternatively, with the side support bracket assemblies 5 (single slot type) mounted flush to the box cabinet's top surface, the complete support frame assembly and sink may be raised inside the cabinet and the four top ramp plates 13 may be attached to the two longitudinal frame rails 6 (support frame assembly and sink in lowest position). A bead of silicon can then be applied 3/8-inches inboard from the edge of the sink's top flange (bowl side). Four 1/16-inches spacers (not shown) may then be positioned around the sink's top flange, making contact with the silicon bead's edge. The support frame assembly and sink may now be raised by hand, and the four ramp plates 14 may then be fitted and then adjusted until the sink forces the spacers to make contact with the underside of the countertop. The spacers may then be removed, extra silicon can be applied if required at the spacer locations, and the silicon can be wiped clean and allowed to set. Once the silicon has set (generally 24 hours), the ramp mechanism can be used to slightly raise the support frame assembly and sink, compressing the set silicon. Some installers prefer to let the silicon set for 24 hours and then trim with a knife and pull the excess free.

The advantage of setting the sink's flange to the underside of the countertop clearance is twofold. First, when the silicon joint has cured, the side support bracket assemblies 5 can be adjusted to compress the silicon. This not only reduces silicon delamination but also transfers weight from the countertop, as noted before. Second, the 1/16-inches silicon bead can be cut easily with a sharp knife. This is not the case with other mounting systems that force the sink's rim flange tightly against the underside of the countertop, thereby forcing most of the silicon out and leaving very little space for a sharp knife to cut the silicon joint.

FIG. 9 shows one of the side support bracket assemblies 5, which includes housing 12 (single lower slot f), top ramp plate 13, bottom ramp plate 14 and optional bottom ramp plate retaining screw 75. Housing 12 is physically attached to the box cabinet's side by screws 11. The two slots (a) are for two optional finishing nails (not shown) which can be installed during final assembly to lock the brackets into position. Housing 12 has a lower ramp (b) of 20-degrees to horizontal and two parallel vertical sides (c). The top ramp plate 13 has a lower ramp of 20-degrees to horizontal (d) and two parallel vertical sides that fit and slide in the two vertical sides (c), located in housing 12. The top ramp plate 13 is raised and lowered by the bottom ramp plate 14 and can only move in a vertical plane. Bottom ramp plate 14 has two opposing 20-degrees-to-horizontal ramps (d) and two parallel vertical sides with reliefs (g) on both sides. The reliefs provide clearance to fit a tool such as a right angle screwdriver (e.g., Tekton 2944), which may be used to physically move the bottom ramp plate from side-to-side in the two parallel vertical sides in housing 12. As the bottom ramp plate 14 is moved from side-to-side, it is raised and lowered due to the bottom ramps (b) in housing 12. The bottom ramp plate 14 can be adjusted anywhere from full left to full right, providing an infinitely adjustable height adjustment as shown in FIG. 8. The top ramp plate 13 is raised or lowered by the bottom ramp plate's 14 sideways movement, and is also sliding on the lower ramp (d) of top ramp plate 13, which is sliding on the top ramp (d) of the lower ramp plate 14. This causes top ramp plate 13 to either raise or lower. Longitudinal frame rail tang 6 (see FIG. 4*d*) is located in the top ramp plate 13 (FIG. 4*b*) and is raised and lowered by the top ramp plate 13.

FIG. 10 shows a side support bracket assembly 5, and a longitudinal frame rail 6 (part of the support frame assembly) in four different positions (Positions A, B, C and D). Position D shows longitudinal frame rail 6 in its highest position at 0.10-inches (2.5-mm) below the top surface of housing 12. Bottom ramp plate 14 is positioned fully to the left in housing 12. Position C shows longitudinal frame rail 6 in its lowest position at 0.40-inches (with the top ramp plate 13 in-place) below the top surface of housing 12. Bottom ramp plate 14 is positioned fully to the right in housing 12. The ramp plates 14 provide a total vertical adjustment (travel) of the support frame assembly and sink, as shown in FIG. 5, of 0.30-inches, which is required as the sink's rim flange thickness varies due to design, manufacturing tolerances and material type. As an example, an undermount porcelain cast iron sink will have a much thicker rim flange than that of a stainless steel sink.

Position B of FIG. 10*b* shows longitudinal frame rail 6 in its lowest position at 2.375-inches below the top surface of housing 12 (bottom ramp plate 14 removed), providing ample room to remove the old silicon sealant and properly clean both surfaces.

Position D shows longitudinal frame rail 6 with the top ramp plate 13 and bottom ramp plate 14 removed. This allows the longitudinal frame rail tangs 6 to pass through the fixed housing's 12 lower slot when lowering the support frame assembly and sink, for complete removal or when installing the support frame assembly and sink from below.

Figure 11A:
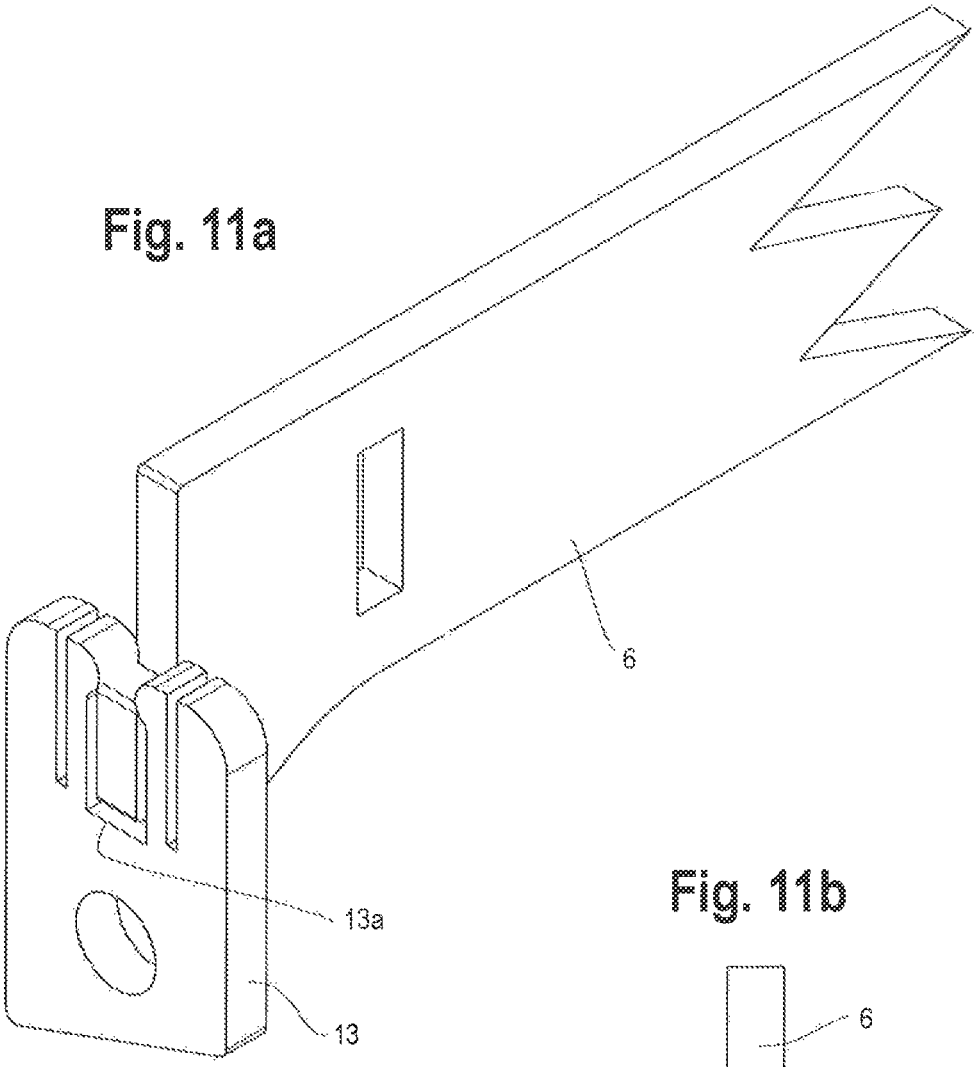
FIGS. 11*a* and 11*b* are side and front perspective views, respectively, showing the relationship between the top ramp 13 and longitudinal frame rail 6.
Figure 11B:
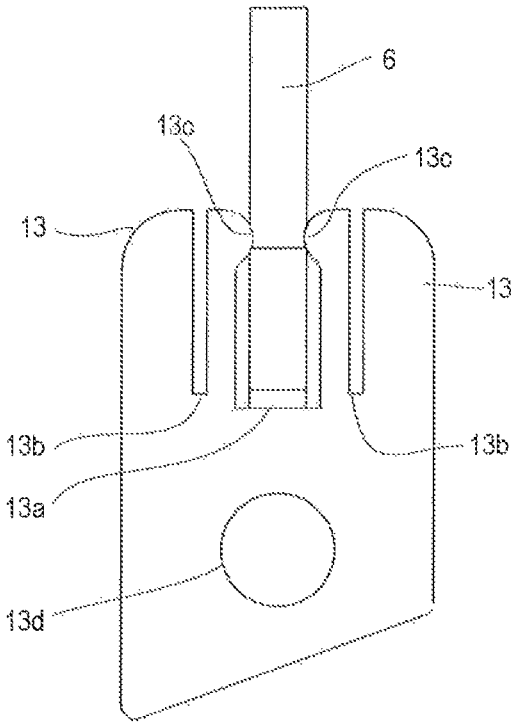

FIGS. 11*a* and 11*b* show the retaining structure that holds the top ramp plates 13 in position. Normally, with weight on the support frame assembly, the longitudinal frame rail 6 sits on ledge 13*a* of top ramp plate 13. Two slots 13*b*, together with two rounded projections 13*c*, form two fingers. The distance across the two rounded projections is less than the width of the longitudinal frame rail 6, and retains top ramp plate 13 loosely to tang 6. Top ramp plate 13 can be attached and removed from the tang by pushing or pulling the top ramp plate with a suitable tool using the access hole 13*d*. The slots allow the fingers to deform (spring) in and out. The top ramp plates 13 are also kept in alignment, parallel to the side support brackets 5 by the retainer face (see FIG. 4*d*, "6 Retainer Face") on the longitudinal frame rails 6.

Figure 12A:
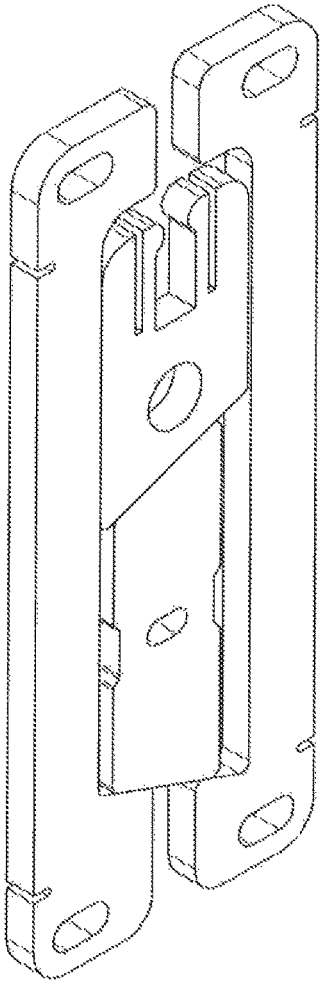
FIGS. 12*a* and 12*b* are side and end perspective views, respectively, showing one of the side support bracket assemblies (double slot) 5, which includes two housings (left and right side) 12, top ramp 13 and bottom ramp 14.
Figure 12B:
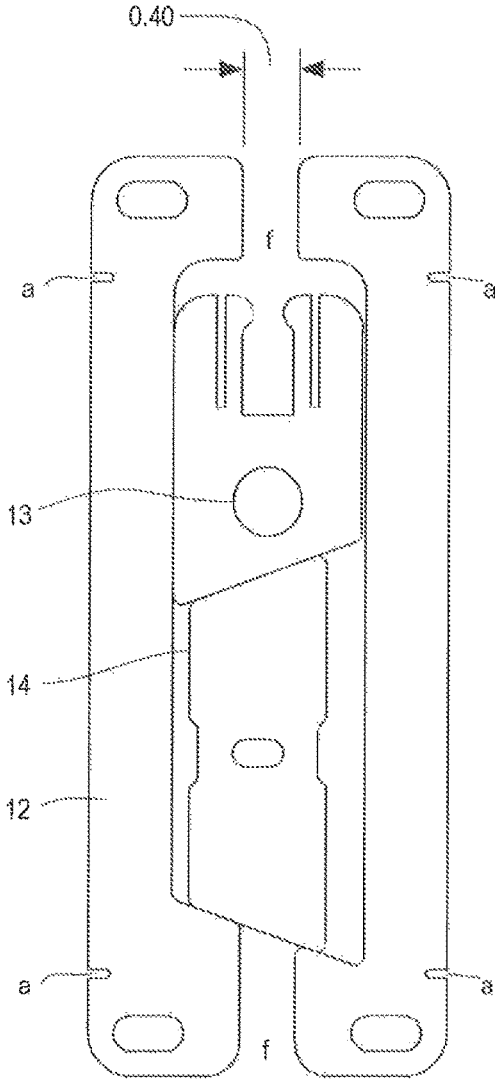

FIGS. 12*a* and 12*b* show another adaptation of the present invention, in which side support bracket assembly 5 has two individual housings 12 (left and right side). The two housings 12 are spaced apart and form a top and bottom slot. This embodiment requires a little more installation time, but has the advantage that the support frame assembly and sink, as shown in FIG. 5, can be fitted (lowered) from the top (countertop not installed) as described in detail above, or from the bottom through the bottom of the box cabinet. The four slots (a) are for four optional finishing nails (not shown) which can be installed during final assembly to lock the brackets into position. This adaption is particularly useful for new construction where multiple units are being installed by the same contractor, as the support frame assembly and sink can be preassembled.

Figure 13A:
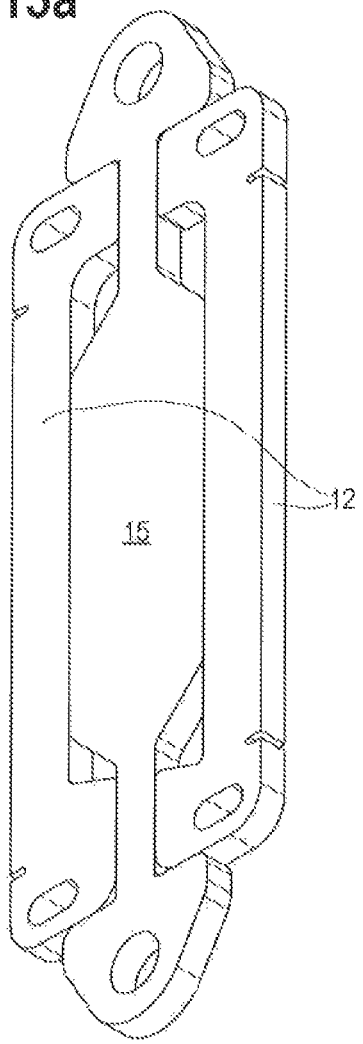
FIGS. 13*a*, 13*b* and 13*c* are side, front and front (assembly spacer gauge 15 only) views, respectively, showing one of the side support bracket assemblies (double slot) 5, which includes two housings (left and right side) 12 together with the assembly spacer gauge 15.
Figure 13B:
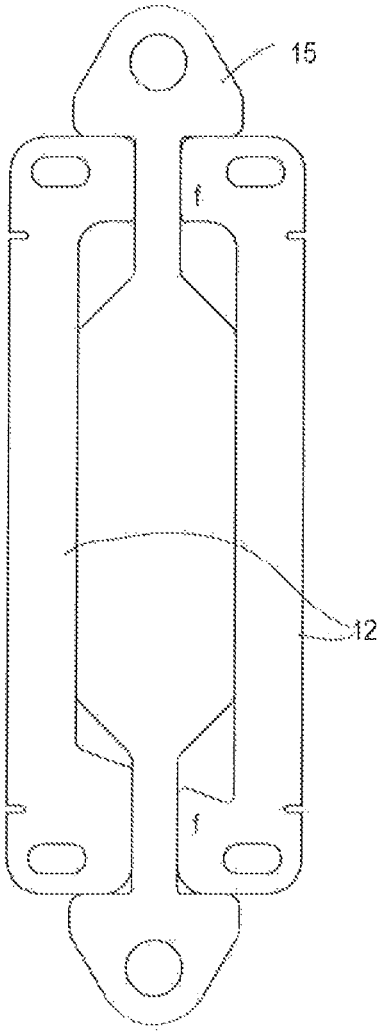
Figure 13C:
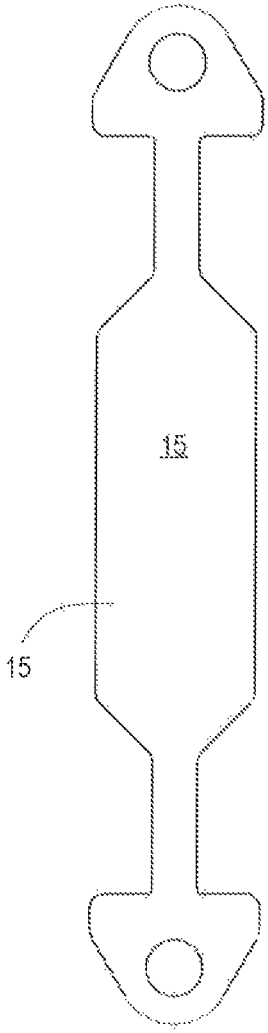

FIGS. 13*a*-13*c* show the assembly spacer gauge 15, used to gauge the correct gap width (0.40-inches) at slots (f), and also to hold the two housings 12 together during assembly to the cabinet's vertical support, using the vertical support's top surface as a reference.

Figure 14A:
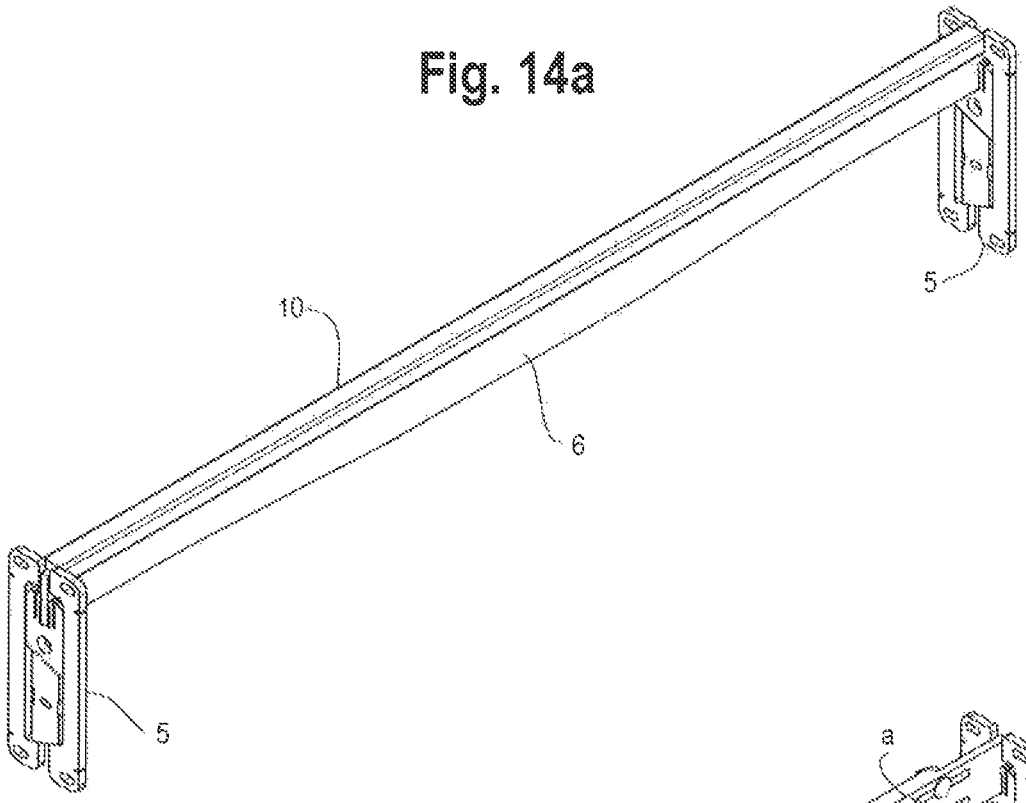
FIGS. 14*a* and 14*b* are perspective views showing two different countertop support rail assemblies with two side support bracket assemblies (double slot) 5, together with longitudinal rails(s) 6 and Sorbothane® visco-elastic polymer vibration dampening/shock absorbing "U"-channel(s) 10.

FIG. 14*a* shows another adaptation of the present invention. The single countertop support rail assembly consists of two double slot, side support bracket assemblies 5, longitudinal frame rail 6 and Sorbothane® visco-elastic polymer vibration dampening/shock absorbing, "U" channel 10, and can be used to add additional support to a countertop. The cross frame rails 7 are not required in this adaptation of the present invention. An example of its use would be at the undercounter dishwasher's location. When using box-style cabinets, the cabinets are located on either side of the dishwasher and the cabinet's sides are not connected together. The cabinets are usually attached only to the back wall. Usually the countertop cannot make contact or be supported by the dishwasher, as the dishwasher has to be removable for servicing. The span between the cabinets is approximately 24-inches. Two double slot, side support brackets assemblies 5 (one on each side of the dishwasher and attached to the cabinet's side) and one longitudinal frame rail 6 located within the two double slot, side support brackets assemblies 5 can be used to support the countertop. The Sorbothane® "U" channel 10 located between the longitudinal frame rail and the countertop provides a cushioned and dampened interface. The side support bracket assemblies are adjusted (as described above) and transfer weight from the countertop to the box cabinet's vertical sides. The side support bracket assemblies 5 require no modification for this application, and they are only 0.25-inches thick, allowing them to be located between the dishwasher and the cabinet's vertical walls. The longitudinal frame rails 6 can be rectangular (same as flat bar) or CAD-profiled, and feature no retainer face or tang, as shown previously in FIG. 4*d*. The rectangular frame rails can be cut to length to fit any width of custom cabinet, while the profiled frame rails can be shortened within a specific amount. The top ramp plates 13 (FIG. 4*a*) are held in place by the two rounded finger projections 13*c* as shown in FIG. 11 (tang shown in this view). When the frame rails are not equipped with tangs, the two rounded fingers are always forced out, thereby positively grabbing the frame rail.

It is the double slot, side support bracket assemblies 5 that allow this feature of the present invention to work, as the frame rails not only sit in and are retained by the top ramp plates 13, but are also located in and retained by the upper slots of the side support bracket assemblies 5. The frame rails can be installed from above if no countertop is installed, or from below if the countertop is already installed. I In most dishwasher installations, it is only possible to support the countertop at the rear (close to the wall). If there is room, the side support bracket assemblies 5 and the longitudinal frame rail 6 can be located at the front of the dishwasher to also support the countertop. The four side support bracket assemblies 5 would be fitted to the cabinet's sides (two per side), the rear longitudinal frame rail 6 and Sorbothane® "U" channel 10 would be installed and adjusted. The dishwasher would then be pushed into place, leveled and attached by its front brackets to the cabinet's sides (one on either side). The front longitudinal frame rail 6 and Sorbothane® "U" channel 10 would then be installed and adjusted.

Figure 4D:
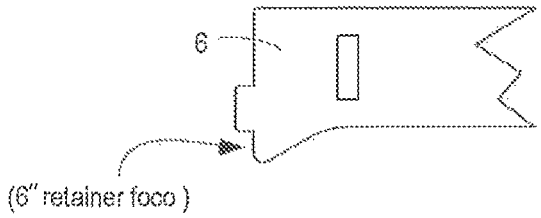
Figure 14B:
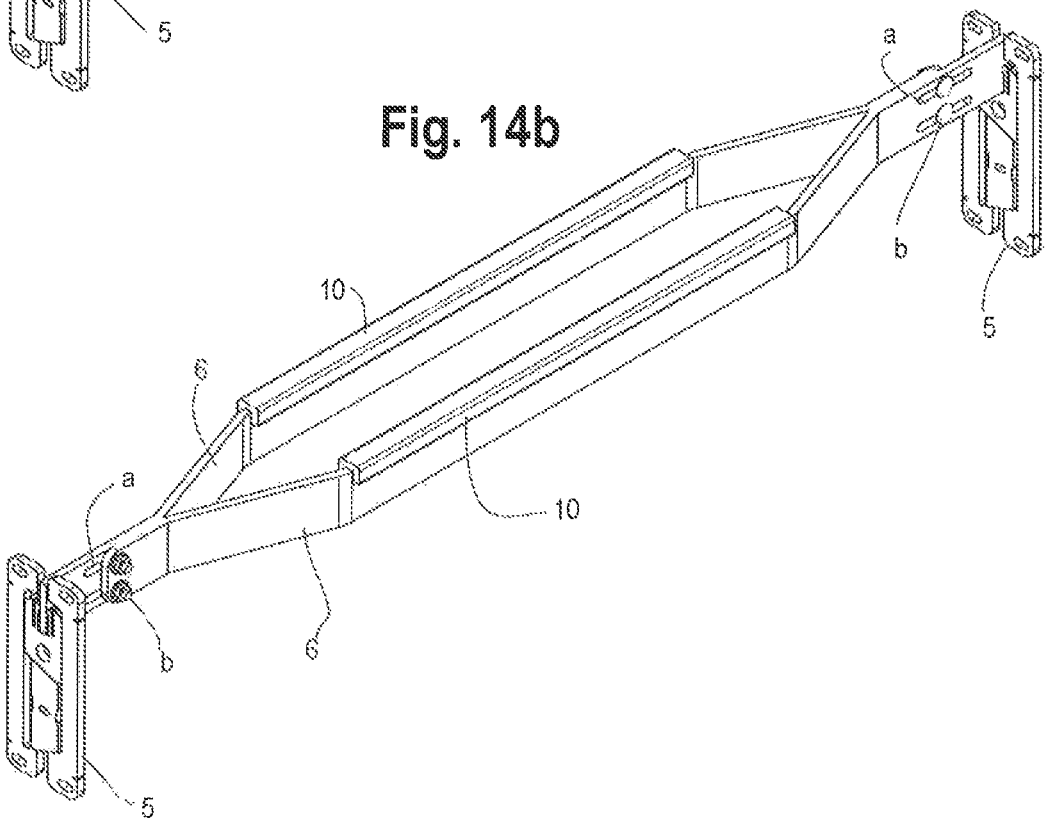

FIG. 14*b* shows another adaptation of the present invention. Here, the single countertop support rail assembly consists of two double slot, side support bracket assemblies 5, two longitudinal frame rails 6 (bolted together) and two Sorbothane® visco-elastic polymer vibration dampening/shock absorbing "U" channels 10, and can be used to add additional support to a countertop. Cross frame rails 7 are not required in this adaptation of the present invention. The two longitudinal frame rails 6 may both be identical in shape and length. Each frame rail may have slots "a" (FIG. 14*b*) on one end, and two holes on the other end. Four round-headed bolts "b" may be located in the holes (hidden by bolts) (FIG. 14*b*) and the adjoining slots on the other frame rail, and clamp the frame rails together. The slots allow the width to be adjusted within a specific range. The longitudinal frame rails 6 can be rectangular or CAD-profiled, and then formed into shape. They have no retainer face or tang, as shown in FIG. 4*d*. The top ramp plates 13, located in the two, double slot, side support brackets assemblies 5, may be held in place by the two rounded finger projections 13*c* (FIG. 11).

This adaptation is ideal for wide box-style bathroom cabinets fitted with 1-cm or 2-cm thick countertops and vessel sinks. Vessel sinks come in all shapes, sizes and materials and sit on top of the countertop. A single 1.875-inches diameter hole may be bored into the countertop, and a popup or grid-type drain may be used to tie (clamp) the sink to the countertop. Silicon adhesive can also be used between the vessel sink and countertop to add additional security. Some of the natural stone vessel sinks can weigh up to 90 pounds. This adaptation of the invention, with its splayed longitudinal frame rails, supports the countertop and vessel sink, and transfers weight to the cabinet's vertical support members. The splayed frame rail allows the vessel sink's drain to pass through the center of the frame rails. Usually, another hole is bored (1.50-inches diameter) in the countertop to support a single-lever type faucet, or the faucet is installed to the back wall.

Figure 15A:
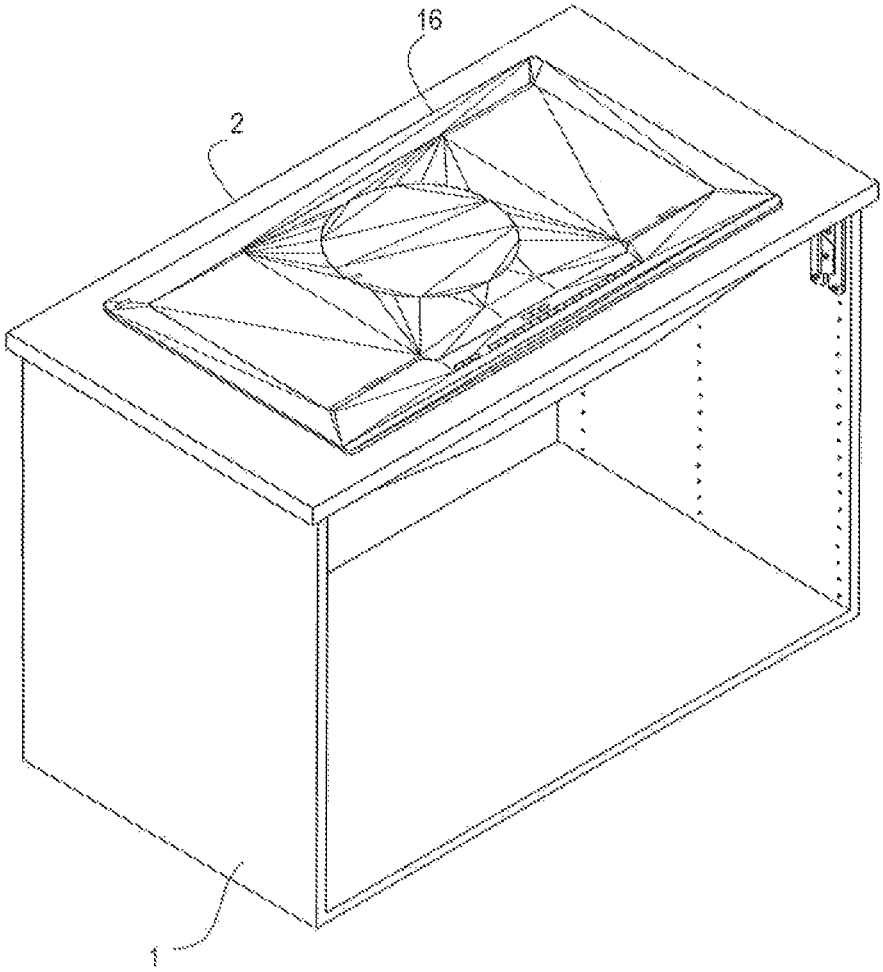
FIGS. 15*a* and 15*b* are planar and front perspective views showing a cabinet 1, countertop 2, countertop cooktop 16, a support rail assembly with four side support bracket assemblies (double slot) 5, together with longitudinal rails(s) 6, cross frame rails 7, Sorbothane® visco-elastic polymer vibration dampening/shock absorbing "U"-channel(s) 10 and foam gasket 17.
Figure 15B:
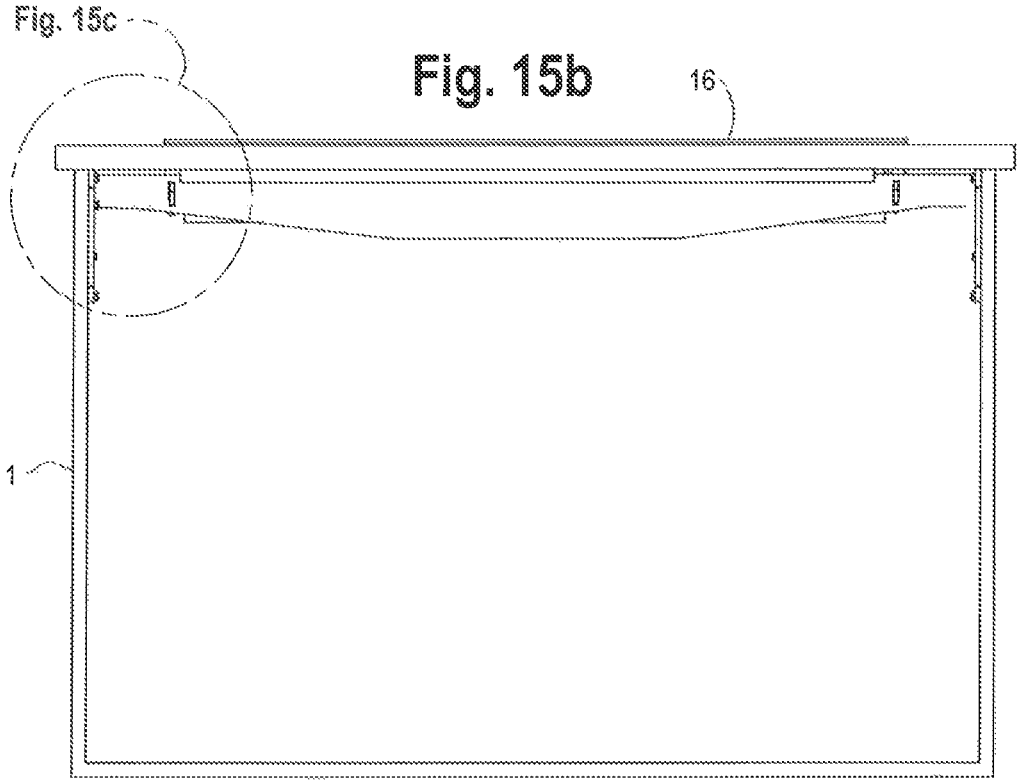
Figure 15C:
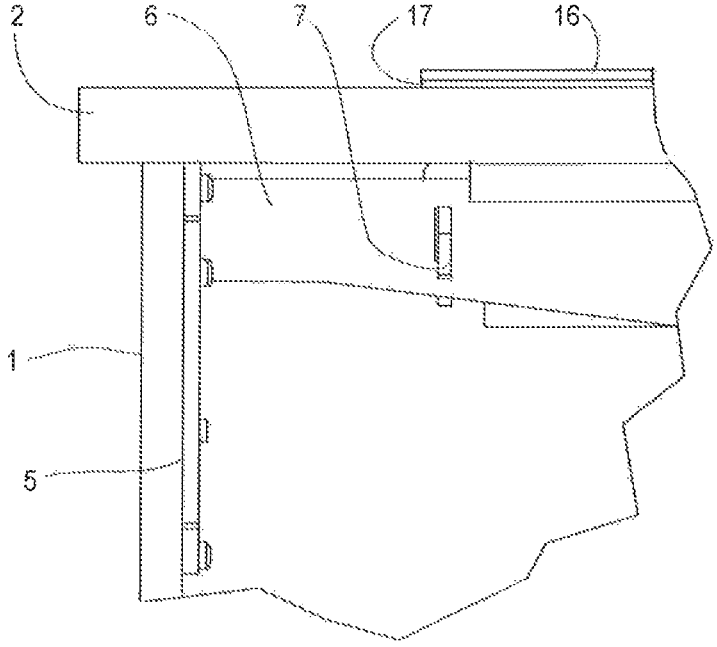
FIG. 15*c* is an enlarged, perspective view of the circled region in FIG. 15*b*.

FIGS. 15*a*, 15*b* and 15*c* show another adaptation of the present invention. Here, a countertop cooktop 16 is mounted (dropped-in) into a countertop. Countertop cooktops are generally drop-in units, available in gas or electric designs, and generally range in length from 30-inches to 45-inches (shown is a 36" electric). The present invention's support structure, as described in detail above for undermount sink installations, is also applicable for cooktop installations. The double slot, side support bracket assembly 5 may be used, together with the support frame assembly, which may include: longitudinal frame rail 6, and cross frame rails 7 together with the Sorbothane® strips or "U" channels 10 as shown in detail in FIG. 15*c*. This is all that is required for this type of installation. The longitudinal frame rail 6 (end tangs and retainer faces not required) and the cross frame rails 7 are designed to suit each installation. However, the double slotted, side support bracket assemblies 5 may be unchanged. The support frame assembly acts directly on the countertop's underside, with the frame rails sitting parallel to and approximately 0.375-inches from the countertop's cooktop cut out edges (four). The silicon joint used in undermount sink installations is not required, while the Sorbothane® "U" channels 10 provides a cushioned interface and also helps to reduce sound transmission. A gasket 17 (generally foam) is placed between the countertop's top surface and the underside of the cooktop's rim flange or glass top to cushion and prevent liquids from entering the cabinet.

The original prototype's side support bracket assemblies 5 include a single housing 12 (see FIGS. 4*a*-4*b*), single lower slot (f) and top ramp plate 13) with a flat upper and lower (horizontal) plane. Bottom ramp plate 14 has a single lower ramp and a flat upper (horizontal) plane. Housing 12 also has a lower matching ramp. Moving the bottom ramp plate from side-to-side causes the top ramp plate to raise and lower due to the sliding ramps of 12 and 13. Adding the opposing, double ramps to the bottom ramp plate, and a single ramp to the top ramp plate, doubles the vertical adjustment travel of the support frame assembly.

The above invention provides a rigid and cushioned support for undermount sinks, countertop cooktops, dishwasher installations and bathroom vessel sinks, or as a general support when a wide span of unsupported countertop is encountered. The prototype which was designed to mount a double-bowl kitchen sink and support the countertop, was an earlier design to the one described above and has been in reliable operation in the inventor's home. It is possible to stand in the sink and jump up and down (170 pounds) without any signs of movement between the sink and granite countertop.

The above description is not intended to limit the meaning of the words used in the following claims that define the invention. Persons of ordinary skill in the art will understand that a variety of other designs still falling within the scope of the following claims may be envisioned and used. It is contemplated that these additional examples, as well as future modifications in structure, function, or result to that disclosed here, will exist that are not substantial changes to what is claimed here, and that all such insubstantial changes in what is claimed are intended to be covered by the claims.

I claim:

1. An undermount support for an appliance, the appliance having a rim flange around at least a portion of its exterior, and the undermount support adapted to attach to cabinetry adjacent the appliance, comprising:

a frame comprising a plurality of frame rails interconnected by two or more bracket assemblies, wherein a top portion of the frame rails lies within a horizontal plane, and each bracket assembly: (a) is attachable to the adjacent cabinetry; (b) is mountable in an orientation generally normal to a longitudinal axis of the frame rails; and (c) comprises a slide mechanism with a housing and a first plate movable and selectively adjustable, in a direction generally parallel to the horizontal frame, thereby pushing on a second plate in a direction generally normal to the horizontal plane, to allow the frame rails be adjusted to a plurality of different heights relative to a height of the adjacent cabinetry;

wherein the frame rails are: (a) assembled around the exterior periphery of the appliance; and (b) located in substantially continuous supporting contact below and with the underside of the rim flange of the appliance;

whereby the frame thereby enables the cabinetry to at least partially support the appliance by the rim flange.

2. The undermount support of claim 1, wherein the appliance comprises one or more of the following: a sink; a dishwasher; a countertop; or a cooktop.

3. The undermount support of claim 2, wherein the sink comprises a single, double or triple-bowl sink.

4. The undermount structure of claim 2, wherein the appliance comprises a sink, and wherein the undermount structure support frame assembly can be used to compress a silicon joint, located between a rim flange of the sink and an underside of the countertop.

5. The undermount support of claim 1, wherein the assembled frame is rectangular in shape and comprises two opposing longitudinal frame rails and two opposing cross frame rails.

6. The undermount support of claim 1, wherein the bracket assemblies are attachable to the adjacent cabinetry.

7. The undermount structure of claim 1, wherein each bracket assembly comprises a top ramp plate, and a bottom ramp plate, and wherein the plates may be configured in a plurality of positions relative to each other to allow a height of the frame to be adjusted to a plurality of different heights relative to a height of the adjacent cabinetry.

8. The undermount structure of claim 7, wherein at least one of the top and bottom ramp plates includes a cutout for receiving a portion of the frame.

9. The undermount structure of claim 1, wherein the frame continuously supports an underside of the rim flange of the appliance.

10. The undermount structure of claim 1, further comprising vibration-dampening/shock-absorbing strips attached to the underside of the rim flange, thereby reducing sound generated by the sink from being transmitted to the cabinet.

11. The undermount structure of claim 10, wherein the vibration-dampening/shock-absorbing strips comprise visco-elastic strips.

12. The undermount structure of claim 1, wherein the frame exerts only a substantially vertically downward force on the adjacent cabinetry, thereby limiting distortion of sides of the cabinetry otherwise caused by substantially horizontal forces exerted on the cabinetry sides.

13. The undermount structure of claim 1, wherein the frame rails are designed using CAD-stress analysis.

14. The undermount structure of claim 13, wherein the frame rails have built-in camber to reduce deflection.

15. The undermount structure of claim 13, wherein the frame rails change in cross-sectional area to reduce deflection.

16. The undermount structure of claim 1, wherein the frame comprises a plurality of splayed frame rails that are adjustable in length, and two double-slotted side support bracket assemblies that support a span of otherwise unsupported countertop, located between two vertical supports or vertical cabinet sides.

17. The undermount structure of claim 1, wherein the bracket assemblies have one or more slots enabling the frame rails to be attached or detached from the bracket assemblies.

* * * * *